US012263389B1

(12) United States Patent
Beatty et al.

(10) Patent No.: US 12,263,389 B1
(45) Date of Patent: Apr. 1, 2025

(54) COMBO FAMILY GAME

(71) Applicants: William H. Beatty, Marana, AZ (US); Brian S. Beatty, Marana, AZ (US)

(72) Inventors: William H. Beatty, Marana, AZ (US); Brian S. Beatty, Marana, AZ (US)

( * ) Notice: Subject to any disclaimer, the term of this patent is extended or adjusted under 35 U.S.C. 154(b) by 0 days.

(21) Appl. No.: 18/678,095

(22) Filed: May 30, 2024

(51) Int. Cl.

| | |
|---|---|
| ***A63B 67/00*** | (2006.01) |
| ***A63B 60/00*** | (2015.01) |
| ***A63B 60/06*** | (2015.01) |
| ***A63B 60/20*** | (2015.01) |
| ***A63B 67/02*** | (2006.01) |
| *A63B 102/36* | (2015.01) |

(52) U.S. Cl.
CPC ..... *A63B 67/002* (2013.01); *A63B 60/0081* (2020.08); *A63B 60/06* (2015.10); *A63B 60/20* (2015.10); *A63B 67/02* (2013.01); *A63B 2102/36* (2015.10); *A63B 2209/08* (2013.01); *A63B 2225/74* (2020.08)

(58) Field of Classification Search
CPC ... A63B 67/002; A63B 60/0081; A63B 60/06; A63B 60/20; A63B 67/02; A63B 2102/36; A63B 2209/08; A63B 2225/74
USPC ..... 473/1, 3, 4, 6, 9, 10, 13–15, 18, 20, 28, 473/44, 46, 410, 411, 412, 558
See application file for complete search history.

(56) References Cited

U.S. PATENT DOCUMENTS

| | | | | | |
|---|---|---|---|---|---|
| 3,229,980 | A * | 1/1966 | Silberman | A63B 69/3632 | 473/232 |
| 3,871,650 | A * | 3/1975 | Casey | A63F 7/0628 | 273/108 |
| 5,259,617 | A * | 11/1993 | Soong | A63B 53/02 | 473/305 |
| 5,551,696 | A * | 9/1996 | Izett | A63B 60/22 | 473/226 |
| 5,553,858 | A * | 9/1996 | McKoon | A63B 69/3685 | 473/294 |
| 5,558,586 | A * | 9/1996 | Izett | A63B 53/007 | 473/294 |
| 5,575,483 | A * | 11/1996 | Dineen | A63B 67/06 | 273/317.2 |
| 5,735,749 | A * | 4/1998 | Charbel | A63D 15/00 | 473/412 |
| 5,988,636 | A * | 11/1999 | Kilmer | A63F 7/36 | 273/284 |
| 6,846,243 | B2 * | 1/2005 | Francisco | A63B 67/002 | 273/123 R |

(Continued)

*Primary Examiner* — Nini F Legesse
(74) *Attorney, Agent, or Firm* — Richard D. Clarke

(57) ABSTRACT

The present application is directed to a Family Combo Game which is played by putting billiard balls into sparkling two sided, numbered, relocatable game traps. The Combo Family Game disclosed herein is a combination of golf, croquet and billiards. The Combo Family Game Club described herein is a combination of a putting club, a pitching or chipping club resembling one or more golf type clubs, and a tapping club resembling a croquet mallet. The game is played on a turf surface of varying heights. The playing surface utilizes an elevated perimeter turf edged boarder to keep the balls in play. The game can be played on grassy area such as a lawn, backyards and in public recreation areas or parks. An optional lighting system is disclosed to light the game traps for playing at night or indoors. Optional game trap decorations and flags are also described herein.

20 Claims, 19 Drawing Sheets

(56) References Cited

U.S. PATENT DOCUMENTS

| | | | | |
|---|---|---|---|---|
| 7,169,058 | B1 * | 1/2007 | Fagan | A63B 53/0487<br>473/340 |
| 2016/0320050 | A1 * | 11/2016 | Barnhart | F21L 4/08 |
| 2018/0056157 | A1 * | 3/2018 | Cohen | A63B 67/02 |

* cited by examiner

COMBO FAMILY GAME

FIELD OF THE INVENTION

This application relates to a Combo Family Game. More particularly, the game of Combo is a game played by putting billiard balls, that are used in billiard pool hall game, hit into sparkling two sided, numbered, relocatable traps. The Combo Family Game disclosed herein is a combination of golf, croquet and billiards. The Combo Game Club described herein is a combination of a putting club, a pitching or chipping club resembling one or more golf type clubs, and a tapping club resembling a croquet mallet. The game is played using a unique style of Combo putter club and billiard ball on a turf surface of varying heights. The playing surface utilizes an elevated perimeter turf edged boarder to keep the balls in play. The game can be played on a Combo style course or on an existing grassy area such as a lawn, backyards and public parks. Scores for the players should be recorded while playing the game on the score card sheets provided with the equipment supplies. A lighting system is available to light the sparkling golf hole traps for evening playing of the game at night or in the home.

BACKGROUND OF THE INVENTION

There have been a number of previously invented games for family fun. The family fun miniature golf game description has been used by many organizations for their family fun centers and miniature golf courses through-out the United States where the game is played with golf balls and conventional golf putters on a short, flat turf surfaces with a concrete or brick border edge to keep the golf balls in play. Miniature Golf is commonly played in a commercial atmosphere where the game involves swinging a metal or plastic head golf style putter and golf ball. Combo is a unique style of game with the option to be used at private homes or in the park locations.

The game of Golf uses a variety of clubs, putters, and golf balls. The ball is struck with varying force to accomplish a desired outcome. The object is to hit the ball on to the putting green and into the cup. These golf courses are most often on large costly commercial locations, with tee boxes, fairways, and greens. Golf courses are not portable and stationary by nature.

The game of Croquet is used by private individuals including families in public parks and homes on conventional lawn surfaces and is inexpensive for families to use and enjoy. The game involves wood clubs or mallets, with wood balls being put through wire hoops in small areas like backyards and public parks.

The game of Horseshoes used by individual groups of two or four people playing in public parks or private locations, using pairs of horseshoes with steel poles in sand pits on either end of the game. Furthermore, over the years unique and unusual games have been invented and patented as follows.

U.S. Pat. No. 5,692,963 issued to Holcombe disclosed a golf game which has disks for simulating holes which may be selectively positioned about the surface of a mat to alter the course layout. The mat may be marked with obstacles to simulate playing hazards. Additionally, a teeing disk may also be provided. The disks are preferably provided with fasteners to temporarily secure the disks to the mat for play. The fastener may be hook and loop, adhesive strip or a staple.

U.S. Pat. No. 6,277,031 issued to Cheek et al. described a two-handled club for use by two persons simultaneously for striking a ball toward a target and a game for using same. The club is such that one handle or grip is oriented as a left-handed club, while the opposite handle is oriented as a right-handed club. A team comprising of two members, each grasps a club handle and simultaneously strikes the ball towards a target. A winner may be determined, for example, by the team requiring the fewest strokes to get to the target.

U.S. Pat. No. 5,116,048 issued to Bilocerkowycz claimed a game comprising: a playing course including an elongated, preferably rectangular playing area arranged on particular given surface, including a marker for defining outer boundaries thereof; a plurality of movable playing pieces placed into play relatively simultaneously, each playing piece adapted to be propelled about the playing course, by a club or stick, under control of a player of the game; a plurality of receptacles positioned about the playing course, to provide a pocket, cup or hole for receiving various ones of the playing pieces when propelled therein by a player, the receptacles positioned in an orientation about the playing course in a manner resembling that of a billiard or pool table.

U.S. Pat. No. 5,308,073 issued to McCoon taught a golf putter which includes a putter head and substantially parallel shafts extending from the putter head, the shafts having gripping sections adapted to be gripped by the golfers hands to move the golf putter. The shafts are bent proximately to the putter head and join the putter head in a plane substantially parallel with the longitudinal axis of the elongated body of the putter head.

U.S. Pat. No. 5,308,073 issued to McDevitt disclosed a golf club comprising a handle and a head having a planar face, a toe portion, a heel portion, and a center of percussion between the toe and heel portions. A dual shaft extends from the handle, comprising a toe shaft and a heel shaft joined respectively to the toe portion and the heel portion of the head. The toe and heel shafts extend into and define the handle. The toe shaft overlies the heel shaft within the handle to define a handle plane which is parallel to the plane of the club head face to give a user an indication through the grip of the orientation of the club face. The toe shaft and the heel shaft diverge at their junction with the handle and extend to the head without interconnection therebetween to mutually independently control the torque applied to the head when a golf ball is impacted off the center of percussion.

U.S. Pat. No. 9,227,122 issued to Jakubowski described an invention which was directed to a game, and more specifically to an outdoor game designed for two or more players that requires navigating a large playing field containing a variety of objects and obstacles. The players navigate the course by hitting a ball with a bat over, through or around the objects while avoiding the obstacles. The starting line, the end line, the game course, the rules for the game and the point system to decide the winner are determined and communicated to the players prior to the game. In the preferred embodiment of the present invention, the player reaching the end line with the fewest strokes is awarded the win. The preferred playing field is a golf course.

None of these previous patents describes or teaches the Combo Family Game and its features. The Combo Family Game disclosed herein is a combination of golf, croquet and billiards. The Combo Game Club described herein is a combination of a putting club, a pitching or chipping club resembling one or more golf type clubs, and a tapping club resembling a croquet mallet. The Combo Game Traps are unique in design. Therefore, there is a need for a new game which is a combination of many other games and can be played on any surface in any lighting and sold in a kit with optional parts and pieces also available to the game owner.

A wide number of families living in areas with a limited number of entertainment centers creates a need for new recreational activities like the Combo game. Taking a family to a commercial entertainment center can be extremely expensive for a young family. The new game of Combo has been designed to have an inexpensive activity that can be constructed in a small area or private back yard. The portable nature of the game allows it to be taken to remote locations like parks and schools. The unique traps or sparkling traps can be used in daylight, artificial light or in darkness of night inside of a home or building or outdoors. Having no surface golf holes or cups makes the game playable and safe on a wide variety of surfaces and attractive in dark areas. Additionally, the game can be sold in kit form or as separate pieces and is easy to transport from place to place.

In this respect, before explaining at least one embodiment of the Family Combo Game in greater detail, it is to be understood that the design is not limited in its application to the details of construction and to the arrangement of the components set forth in the following description or illustrated in the drawings. The Family Combo Game is capable of other embodiments and of being practiced and carried out in various ways. Also, it is to be understood that the phraseology and terminology employed herein are for the purpose of description and should not be regarded as limiting.

SUMMARY OF THE INVENTION

The primary advantage of the Family Combo Game is that several people can play the game at the same time in a relatively small area.

Another advantage of the Family Combo Game is safety, there are no open golf holes on the playing surface.

Yet another advantage of the Family Combo Game is the game uses sparkling traps with the option of using the pathway lighting system that will increase the visibility to enable readily seeing trap locations in dark areas or when the game is played at night in the dark.

A further advantage of the Family Combo Game is to have relocatable sparkling traps, that when turned over, a new number on the trap is displayed to extend the game playing time.

Another advantage of the Family Combo Game is that the game is portable and can be taken to, and played in, a wide variety of locations.

Yet another advantage of the Family Combo Game is that the game is competitive but does not require a great deal of skill to play and it is suitable for all ages.

A further advantage of the Family Combo Game is to use a new and unique type of Combo club head design with two round smooth hand grips, vertical rods with locking nuts, a sight line on the club for tapping the ball top surface and unique club scoop-chipping, contoured head to elevate the travel of the ball. The Combo club is substantially different than the single grip putter design used on conventional golf clubs.

Another advantage of the Family Combo Game is that the game of Combo requires a softer striking force than regularly used to hit the golf balls on commercial golf courses.

Yet another advantage of the Family Combo Game is that the course will be played on medium length turf with the longer turf perimeter edge border to keep the balls in play and be convenient to maintain.

A further advantage of the Family Combo Game is that it is not being played with a standard golf ball but with a larger heavier billiard ball that is used in a billiard pool game.

Another advantage of the Family Combo Game is that it is played on a surface that will have several raised humps of four inches of a maximum height on the turf surface to increase the challenge of the sport.

Another advantage of the Family Combo Game is that with the relocatable sparkling traps no open golf holes on the surface, it will keep people from stepping accidentally in the golf holes while playing the game.

Another advantage of the Family Combo Game is the longer turf perimeter border edge on the playing surface, which is used to replace the most often used brick edging which often comes loose. The brick or concrete edging can cause people to trip when the bricks have come loose on the concrete border walkway system.

Another advantage of the Family Combo Game is that it is inexpensive and only requires a single carpeted playing surface or grass area.

Another advantage of the Family Combo Game is that it can be bundled into a complete game kit package for sale to the public or businesses.

Another advantage of the Family Combo Game is that it can be purchased in different size packages ranging from two items or more and sold in small sets.

A further advantage of the Family Combo Game is that optional equipment can be provided such as trap flags, trap decorations and differing sizes of combo club shafts to accommodate players of differing heights and ages.

Another advantage of the Family Combo Game is that it can be installed in public places such as parks, recreation areas, campgrounds, churches, schools and sports stadiums.

These together with other advantages of the Family Combo Game, along with the various features of novelty, which characterize the design are pointed out with particularity in the claims annexed to and forming a part of this disclosure. For a better understanding of the Family Combo Game its operating advantages and the specific objects attained by its uses, reference should be made to the accompanying drawings and descriptive matter in which there are illustrated the preferred and alternate embodiments of the Family Combo Game. There has thus been outlined, rather broadly, the more important features of the design in order that the detailed description thereof that follows may be better understood, and in order that the present contribution to the art may be better appreciated. There are additional features of the Family Combo Game that will be described hereinafter, and which will form the subject matter of the claims appended hereto.

The preferred embodiment of the Family Combo Game will consist of a combo family game comprising: (a) a game mat playing surface; (b) one or more game balls; (c) one or more game clubs; and (d) one or more game ball traps. The game mat playing surface comprises a flat surface and the game mat playing surface may include a raised border to prevent the game ball from rolling off said game mat playing surface. The game mat playing surface may also include one or more game surface obstacles capable of being adjustably arranged in a variable desired pattern. The game mat playing surface may be constructed of artificial grass or turf. The combo family game balls includes billiard balls. The combo family game billiard balls are configured in varying colors, varying numbers and varying patterns. The combo game clubs include game clubs having two game club handles, two game club flexible shafts and one game club head. The combo family game clubs have a game club head which includes four different striking surfaces. Those four different striking surfaces includes a flat putting surface, a curved chipping surface, a left side tapping surface and a right side tapping surface. The combo family game club each have two game club handles including spherically shaped handles. The combo family game club handles may further include magnets therein. The combo family game clubs with two game club flexible shafts include flexible shafts configured in varying sizes for accommodating varying sized game players. The combo family game clubs have two game club flexible shafts which are secured to said two game club handles on one end using lock nuts and the two game club flexible shafts are secured to said club head on the opposite end. The combo family game ball traps include flat surfaced U-shaped game ball traps having a ball accepting slot integrated therein. The combo family game flat surfaced U-shaped game ball traps further include a sparkle surface and reflective surface and can be numbered. The combo family game is configured such that all of said game components are assemble for sale in a portable combo family game kit. The combo family game wherein said portable combo family game kit further includes a lighting and wiring kit component. The combo family game wherein said portable combo family game kit further includes a decorations and flags kit component. The combo family game is configured such that said combo family game is capable of being constructed as a permanent structure in a family recreation area.

In alternate embodiments of the Family Combo Game the game may be sold as a portable kit able to be transported and set up in any area suitable for playing the game. That kit may be added to by available lighting kits and decorations and flags kits as add-ons.

Therefore, in summary, the Family Combo Game primary features will include as prominent design and operational features: a combo family game comprising: (a) a game mat playing surface; (b) one or more game balls; (c) one or more game clubs; and (d) one or more game ball traps. The game mat playing surface comprises a flat surface and the game mat playing surface may include a raised border to prevent the game ball from rolling off said game mat playing surface. The game mat playing surface may also include one or more game surface obstacles capable of being adjustably arranged in a variable desired pattern. The game mat playing surface may be constructed of artificial grass or turf. The combo family game balls includes billiard balls. The combo family game billiard balls are configured in varying colors, varying numbers and varying patterns. The combo game clubs include game clubs having two game club handles, two game club flexible shafts and one game club head. The combo family game clubs have a game club head which includes four different striking surfaces. Those four different striking surfaces includes a flat putting surface, a curved chipping surface, a left side tapping surface and a right side tapping surface. The combo family game club each have two game club handles including spherically shaped handles. The combo family game club handles may further include magnets therein. The combo family game clubs with two game club flexible shafts include flexible shafts configured in varying sizes for accommodating varying sized game players. The combo family game clubs have two game club flexible shafts which are secured to said two game club handles on one end using lock nuts and the two game club flexible shafts are secured to said club head on the opposite end. The combo family game ball traps include flat surfaced U-shaped game ball traps having a ball accepting slot integrated therein. The combo family game flat surfaced U-shaped game ball traps further include a sparkle surface and reflective surface and can be numbered. The combo family game is configured such that all of said game components are assemble for sale in a portable combo family game kit. The combo family game wherein said portable combo family game kit further includes a lighting and wiring kit component. The combo family game wherein said portable combo family game kit further includes a decorations and flags kit component. The combo family game is configured such that said combo family game is capable of being constructed as a permanent structure in a family recreation area.

With respect to the above description then, it is to be realized that the optimum dimensional relationships for the parts of the Family Combo Game, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Family Combo Game. Further, since numerous modifications and changes will readily occur to those skilled in the art, it is not desired to limit the Family Combo Game to the exact construction and operation shown and described, and accordingly, all suitable modifications and equivalents may be resorted to falling within the scope of this application.

BRIEF DESCRIPTION OF THE DRAWINGS

The accompanying drawings, which are incorporated in and form a part of this specification, illustrate embodiments of the Family Combo Game and together with the description, serve to explain the principles of this application.

DETAILED DESCRIPTION OF THE PREFERRED EMBODIMENTS

Figure 1:
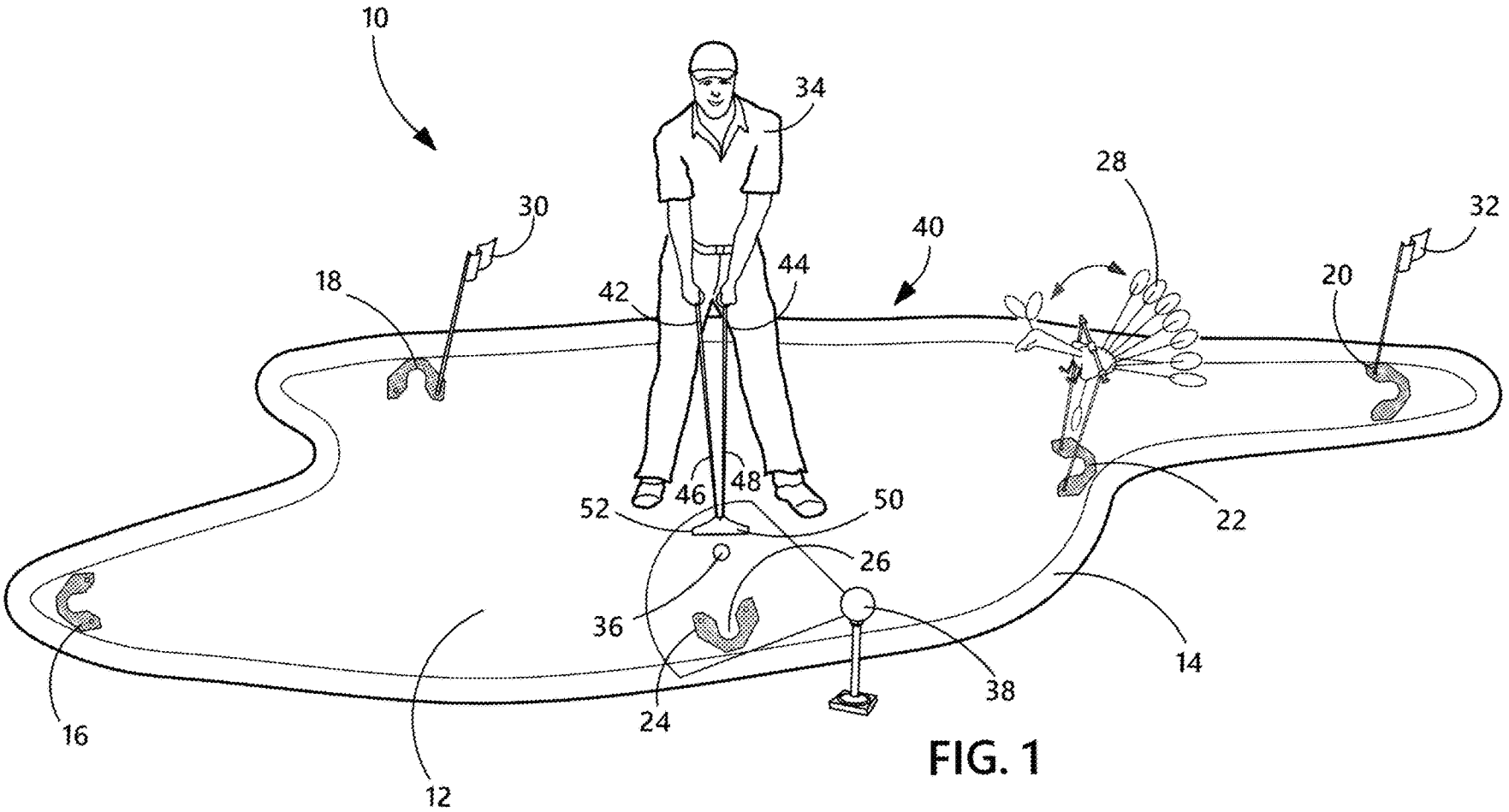
FIG. 1 depicts a Combo Family Game set up including the game mat, game traps, optional game lighting, optional trap decorations and a game player using a Combo Game Club putting a ball into a trap.

As required, the detailed embodiments of the present Family Combo Game 10, the Combo Game Club 40 and 140, the Combo game traps 300, 320, 330, 350 and 370, as well as a Combo Family Game kit 400 and optional Combo Family Game lights 500, lighting wiring 520 and various game trap decorations 540 and game trap flags 560, are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure as well as combination.

FIG. 1 depicts a Combo Family Game 10 set up including the game mat, game traps, optional game lighting, optional trap decorations and a game player using a Combo Game Club putting a ball into a trap. The Family Combo Game is played on a game mat 12 having a raised portion 14 on the border of said game mat 12. Any number of game traps 16, 18, 20, 22 and 24 are placed on the game mat 12 in any desired order, placement or arrangement. Each game trap, for example game trap 24, has a ball accepting slot 26. Optionally, the game traps can be decorated with ornaments, such as the swinging peacock 28 shown here (also see FIG. 37). Game traps may also have one or more holes therein to accept ornaments and or flags, such as flags 30 and 32 (also see FIG. 38). A Combo Family Game 10 player 34 will use a billiard ball for the game ball 36 to run the Combo Family Game 10 course of arranged game traps. The game player 34 will employ a game club 40 having two handles 42 and 44 at the ends of two flexible shafts 46 and 48. The game club will have a game club head 50 which will consist of four differing game club game ball 36 striking surfaces 52 (see below FIG. 3-FIG. 23 for more game club detail). So that the Combo Family Game 10 may be played at night or in darkness, optional game lights 38 may be placed at one or more of the game traps, as shown (see FIGS. 35 and 36 for game lighting kits detail).

Figure 2:
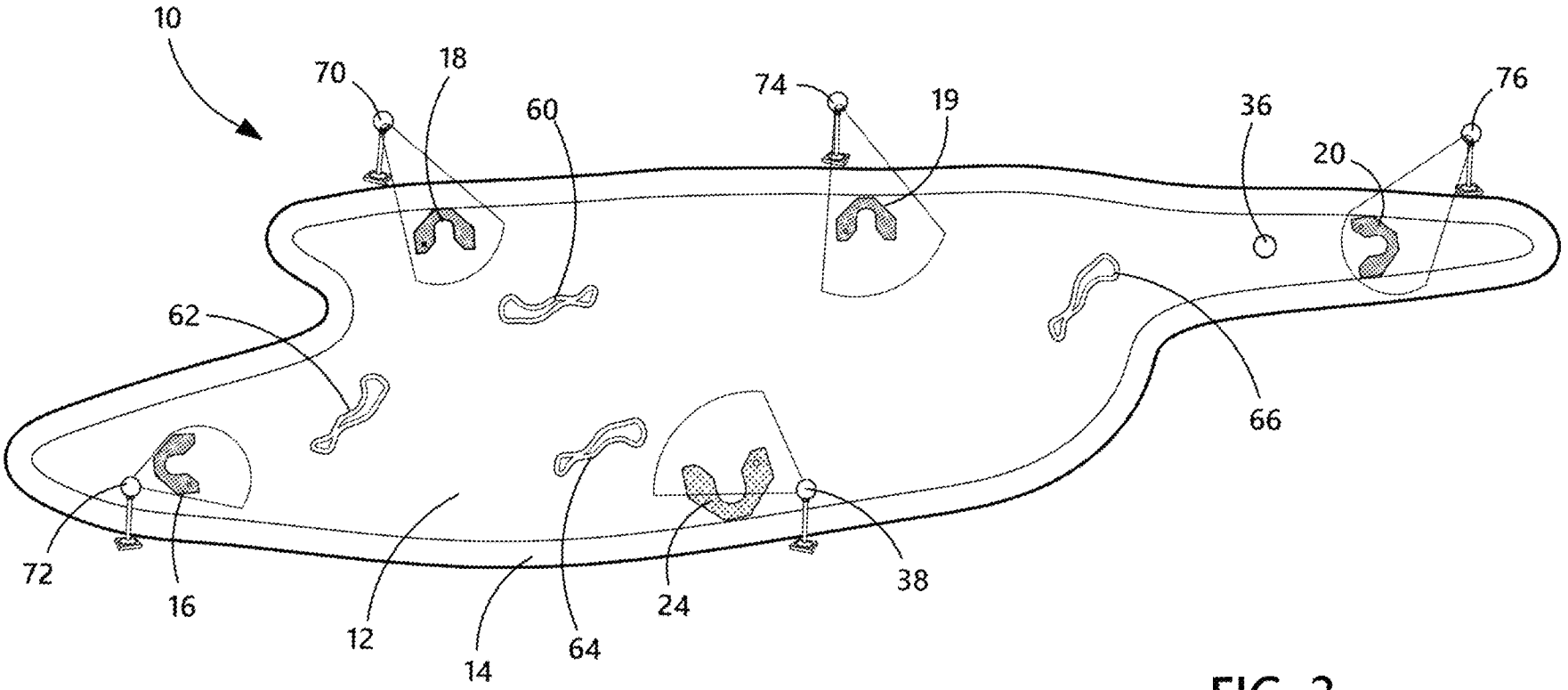
FIG. 2 depicts a Combo Family Game set up including the game mat, game traps, optional game lighting shining a light on each game trap and illustrating the game mat having several optional game obstacles arranged on the game mat surface.

FIG. 2 depicts a Combo Family Game 10 set up including the game mat 12, game traps 16, 18, 19, 20 and 24 with an optional game lighting fixture 70, 72, 74, 76 and 38 shining a light on each associated game trap, respectively. This FIG. 2 also illustrates the game mat 12 having several optional game obstacles 60, 62, 64 and 66 arranged on the game mat surface. These game obstacles 60, 62, 64 and 66 can be placed under the mat to alter the surface topography of the game mat 12, or they may be placed on the top of the game mat 12 to act as obstacles which must be avoided when striking the game ball 36 into the game traps 16, 18, 19, 20 and 24. Moreover, the game obstacles 60, 62, 64 and 66 can be constructed such that they are malleable and formable into varying shapes and sizes of game obstacle structures.

Figure 3:
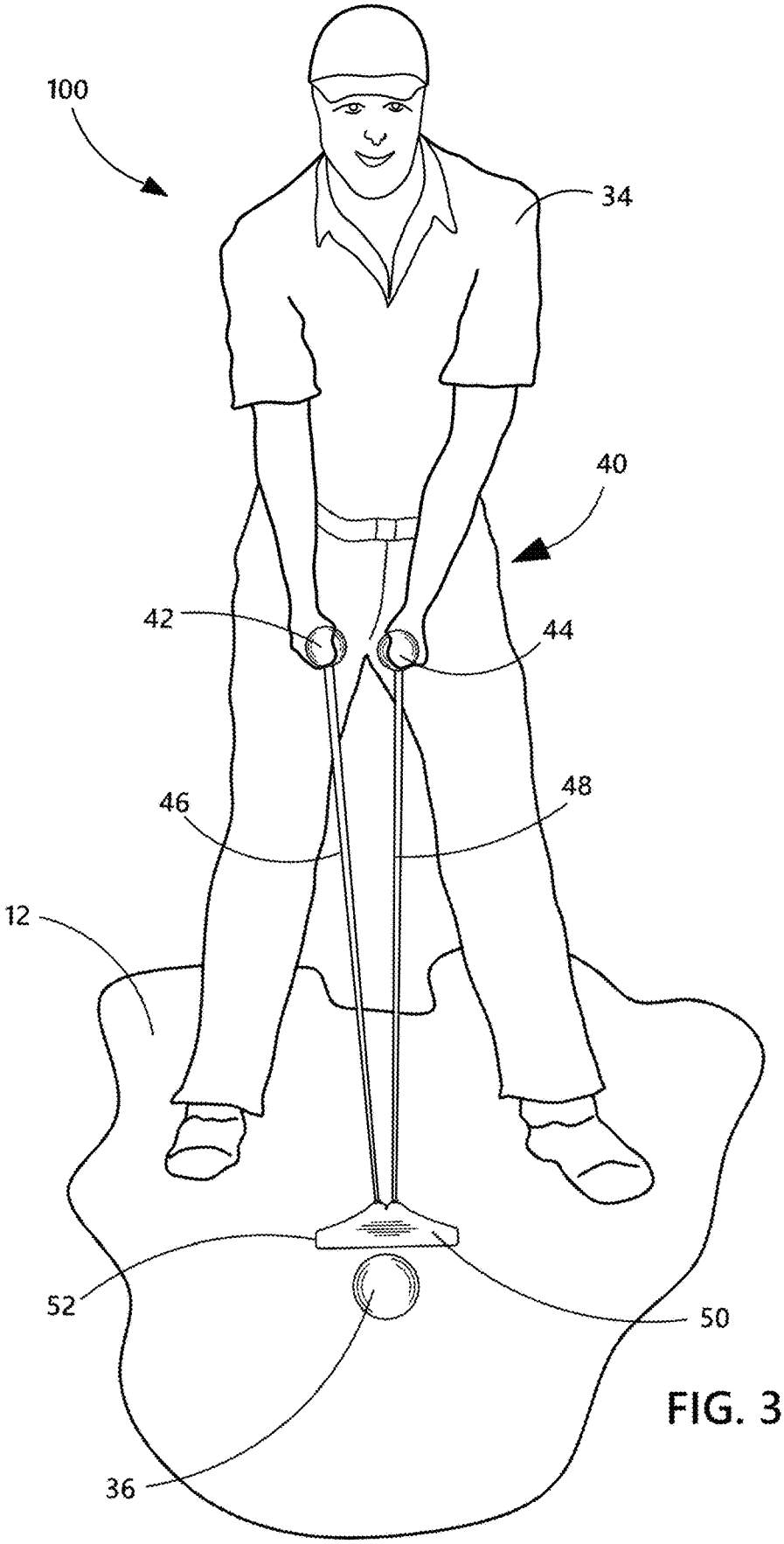
FIG. 3 depicts a game player using a Combo Game Club flat putting surface to putt a ball on the game mat where the club handles are spread apart.

FIG. 3 depicts a game player game stance 100 using a Combo Game Club 40 flat putting surface 50 to putt a game ball 36 on the game mat 12 where the club handles 42 and 44 are spread apart. The special Family Combo Game club 40 is constructed using flexible game club shafts 46 and 48, having handles 42 and 44 on one end and a game club head flat surface 50 on the opposing end. In this FIG. 3, the flat surface club head 50 is being used rather than the flat club head side surface 52 to strike or putt game ball 36. The player 34 stance 100 is one in which the player 34 stands with feet apart and faces the game ball 36. The player then swings the game club 40 between the legs and outward to strike the game ball 36. This may be done with the game club handles 42 and 44 apart, as shown here.

Figure 4:
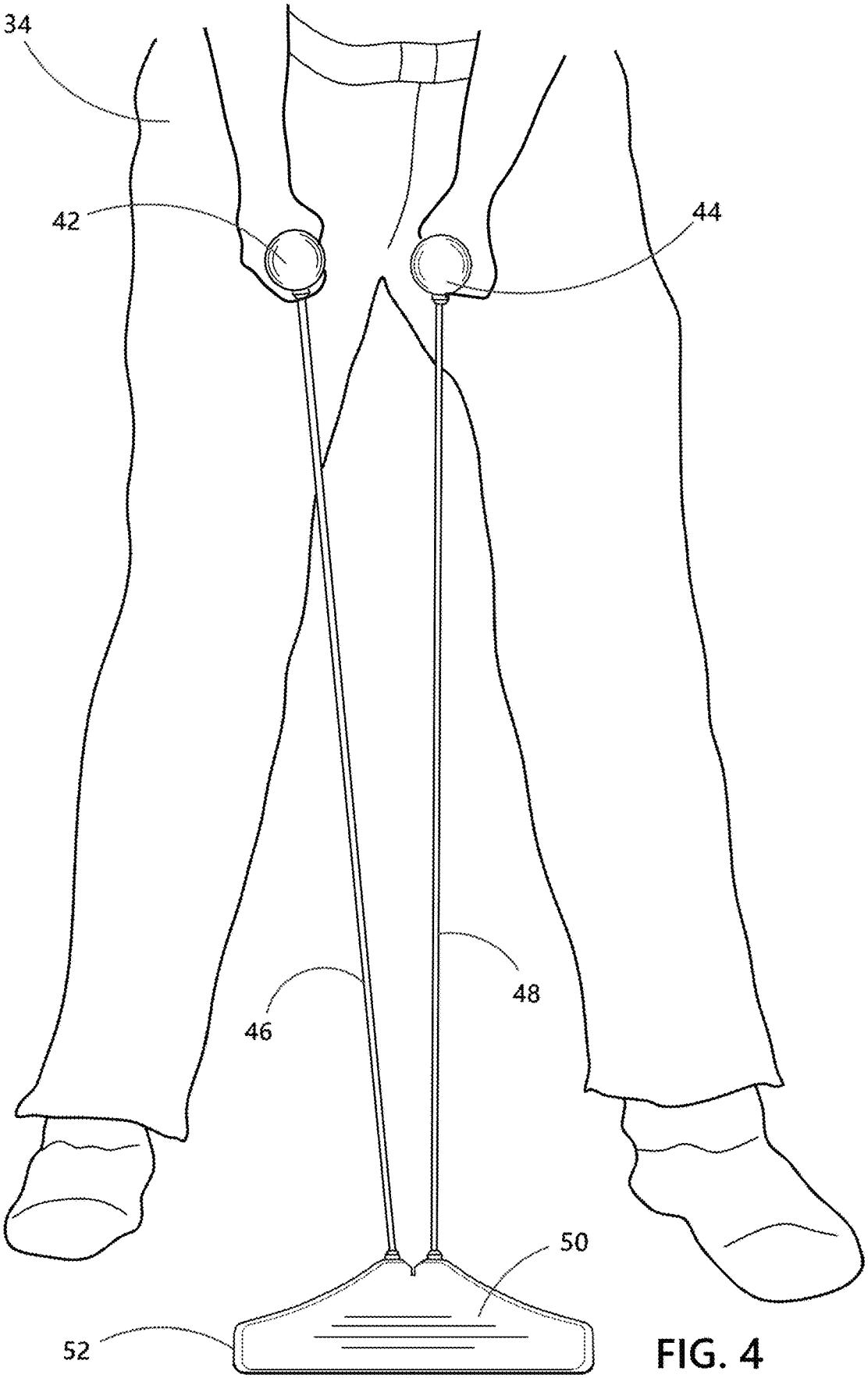
FIG. 4 depicts an enlarged view of a game player using a Combo Game Club flat putting surface to putt a ball on the game mat where the club handles are spread apart.

FIG. 4 depicts an enlarged view of a game player stance 100 as shown in FIG. 3 above, using a Combo Game Club 40 flat putting surface 50 to putt a game ball 36 (not shown) on the game mat 12 where the club handles 42 and 44 are spread apart. Again, as explained above, the special Family Combo Game club 40 is constructed using flexible game club shafts 46 and 48, having handles 42 and 44 on one end and a game club head flat surface 50 on the opposing end. The preferred embodiment has game club handles 42 and 44 which are spherical in shape and can be constructed using a billiard ball or some other suitable spherical object. In this FIG. 4, the flat surface club head 50 is being used rather than the flat club head side surface 52 to strike or putt game ball 36 (not shown). The player 34 stance 100 is one in which the player 34 stands with feet apart and faces the game ball 36 (not shown). The player then swings the game club 40 between the legs and outward to strike the game ball 36 (not shown). This may be done with the game club handles 42 and 44 apart, as shown here.

Figure 5:
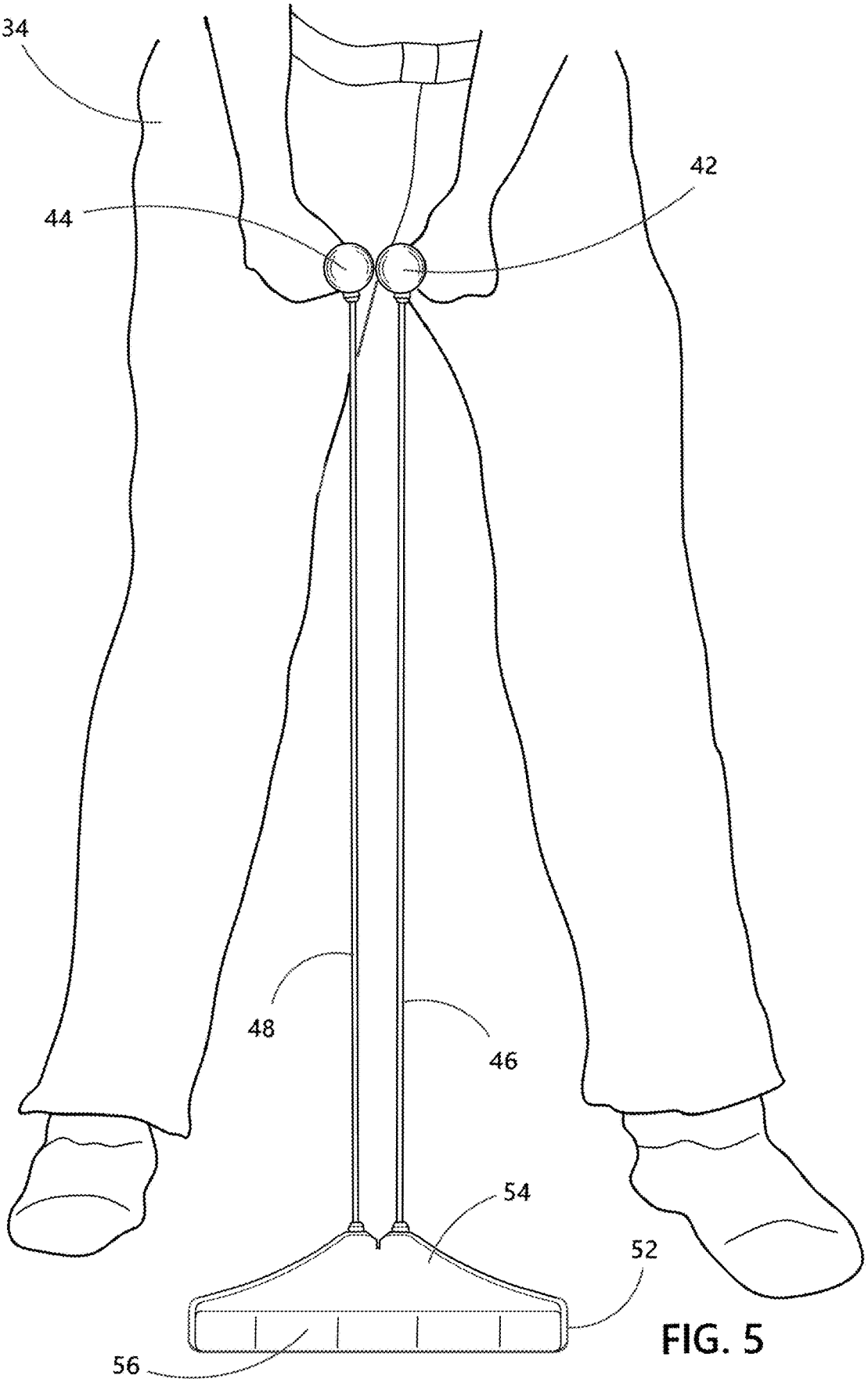
FIG. 5 depicts an enlarged view of a game player using a Combo Game Club curved chipping surface to putt a ball on the game mat where the club handles are moved together.

FIG. 5 depicts an enlarged view of a game player 34 using a Combo Game Club 40 here using the game club head 54 curved chipping surface 56 to putt a game ball 36 (not shown) on the game mat where the club handles 42 and 44 are moved together. The flexible game club shafts 46 and 48 enable the handles to move apart or together as desired. The curved chipping club head surface 56 enables the player 34 to strike the ball and chip it upwardly, to possibly avoid an obstacle and land the ball near or in a game trap (not shown).

Figure 6:
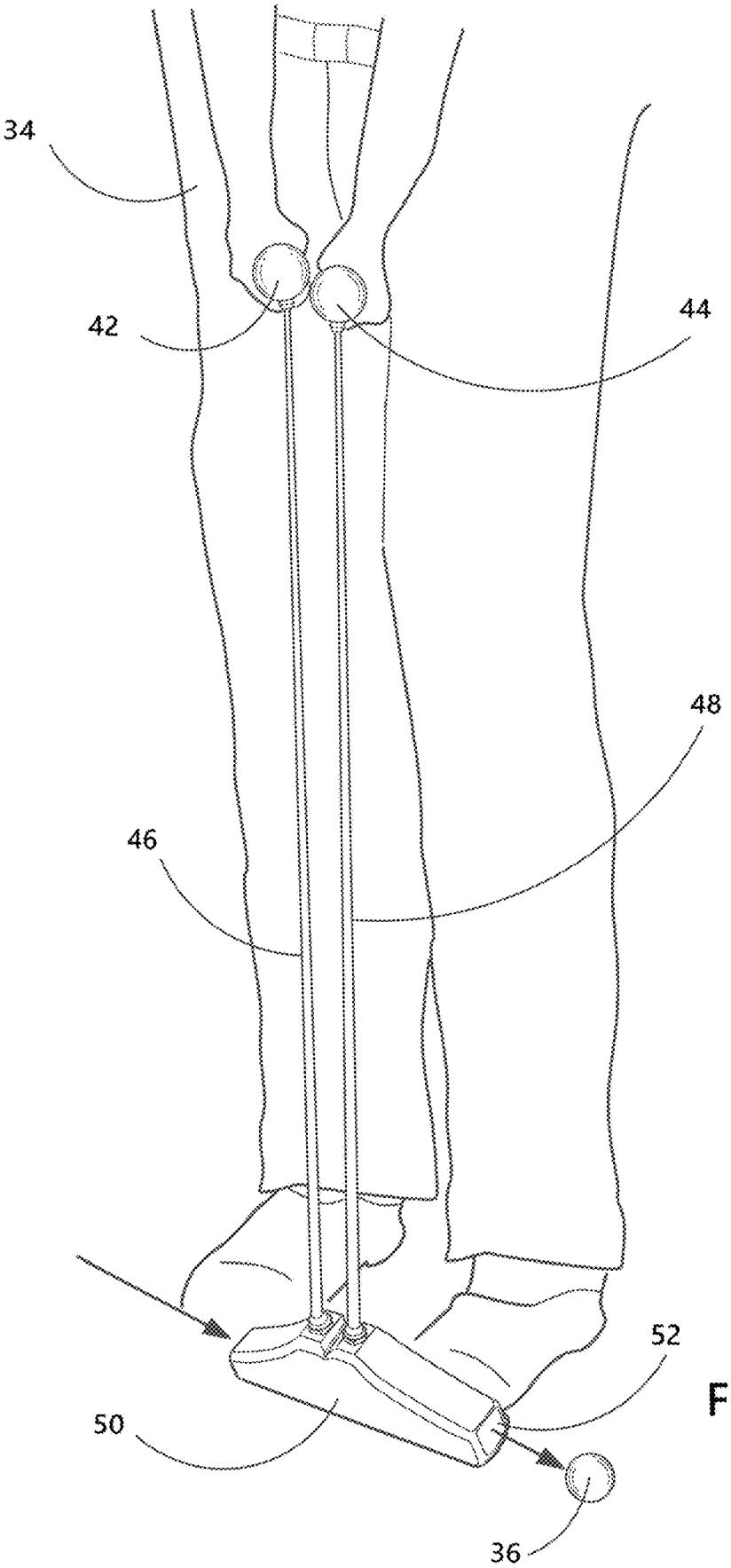
FIG. 6 depicts a game player using a Combo Game Club side tapping surface to tap a ball on the game mat where the club handles are moved together.

FIG. 6 depicts an alternate game player 34 stance using a Combo Game Club head 50 side tapping surface 52 to tap a game ball 36 on the game mat (not shown) where the club handles 42 and 44 are moved together. Here the stand is different. The game player stands with the feet together and swings the game club sideways to tap the game ball 36 using one of the two side surfaces 52 of the game club head 50. This game player stance and game club use bears a resemblance to a golfer putting a golf ball.

Figure 7:
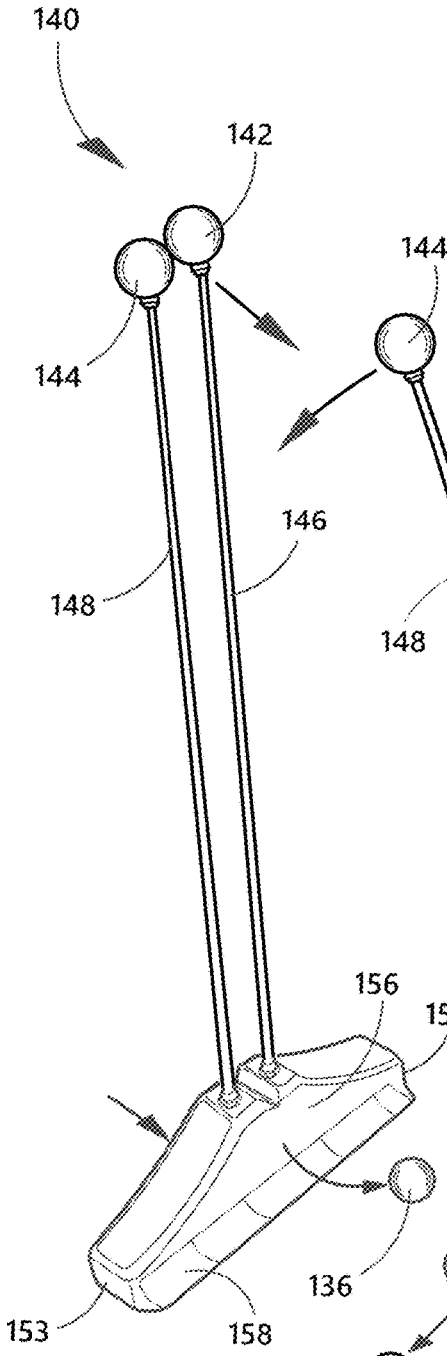
FIG. 7 depicts a top perspective view of a Combo Game Club showing the curved chipping surface swinging toward a ball, here illustrating the handles moved together.

FIG. 7 depicts a top perspective view of a Combo Game Club 140 showing the curved chipping surface 158 of the game club head 156 swinging toward a game ball 136, here illustrating that the game club 140 handles 142 and 144 are moved together and the flexible game club shafts 146 and 148 are nearly parallel. Also seen here in FIG. 7 are the club head sides 152 (not shown) and 153. The game club 140 is swung in the direction of the motion arrows and when striking the game ball 136 with this curved game club surface 158, the game ball 136 is effectively chipped upwardly moving forward.

Figure 8:
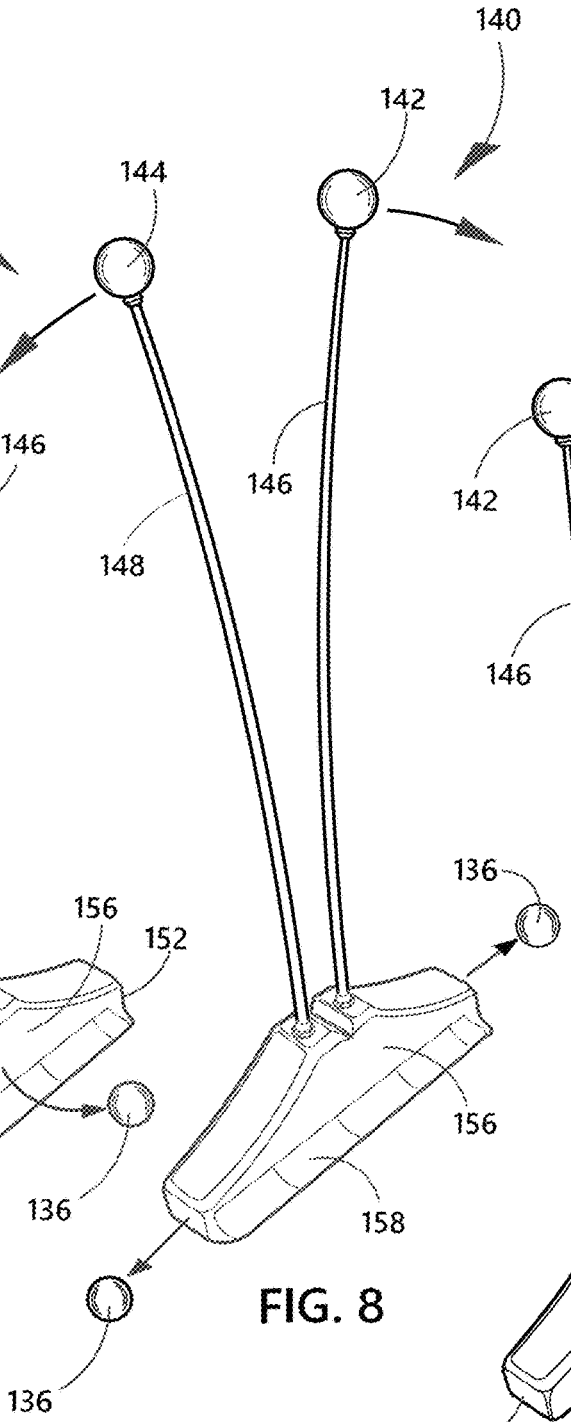
FIG. 8 depicts a Combo Game Club showing the side tapping surfaces on both sides of the Combo Game Club swinging sideways tapping a ball, here illustrating the handles moved apart by flexing the flexible Game Club shafts attached to the handles.

FIG. 8 depicts a Combo Game Club 140 showing the game club head 156 side tapping surfaces on both sides, namely, the right side and the left side (see FIG. 9) of the Combo Game Club 140 club head 156 swinging sideways tapping a ball 136, here illustrating the game club handles 142 and 148 moved apart by flexing the flexible Game Club shafts 146 and 148 attached to the handles, in a nearly V-shaped configuration. The game club 140 is swung in the direction of the motion arrows and when tapping the game ball 136 with this flat left and right side game club surface 152 and 153, the game ball 136 is effectively tapped to move forward (see direction arrows).

Figure 9:
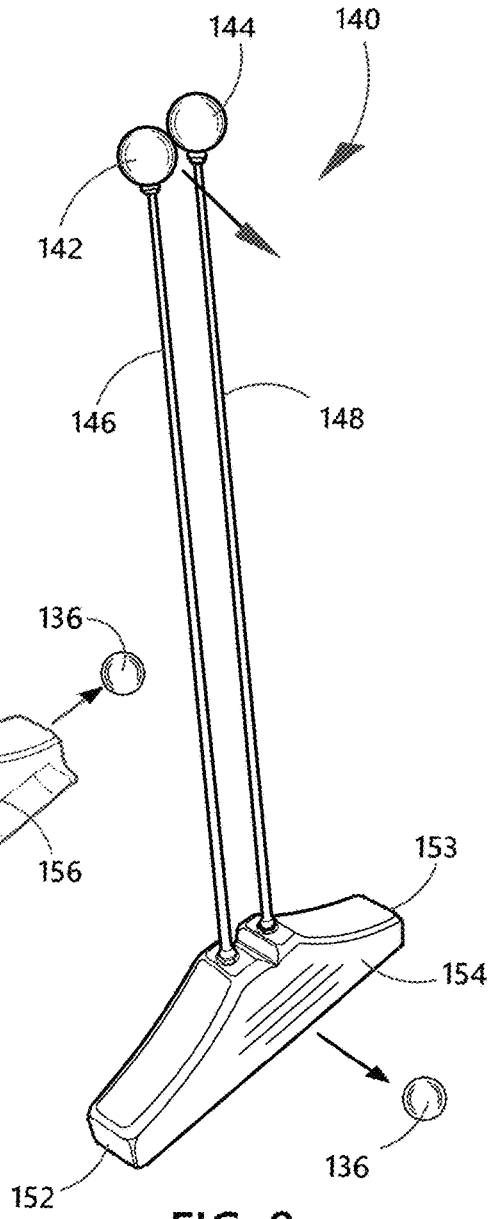
FIG. 9 depicts a top perspective view of a Combo Game Club showing the flat putting surface swinging toward a ball, here illustrating the handles moved together.

FIG. 9 depicts a top perspective view of a Combo Game Club 140 showing the flat putting surface 154 of the game club head 156 swinging toward a game ball 136, here illustrating that the game club 140 handles 142 and 144 are moved together and the flexible game club shafts 146 and 148 are nearly parallel. Also seen here in FIG. 9 are the club head sides 152 and 153. The game club 140 is swung in the direction of the motion arrows and when striking the game ball 136 with this flat putting game club surface 154, the game ball 136 is effectively putted and moves forward in the direction of the arrow.

Figure 10:
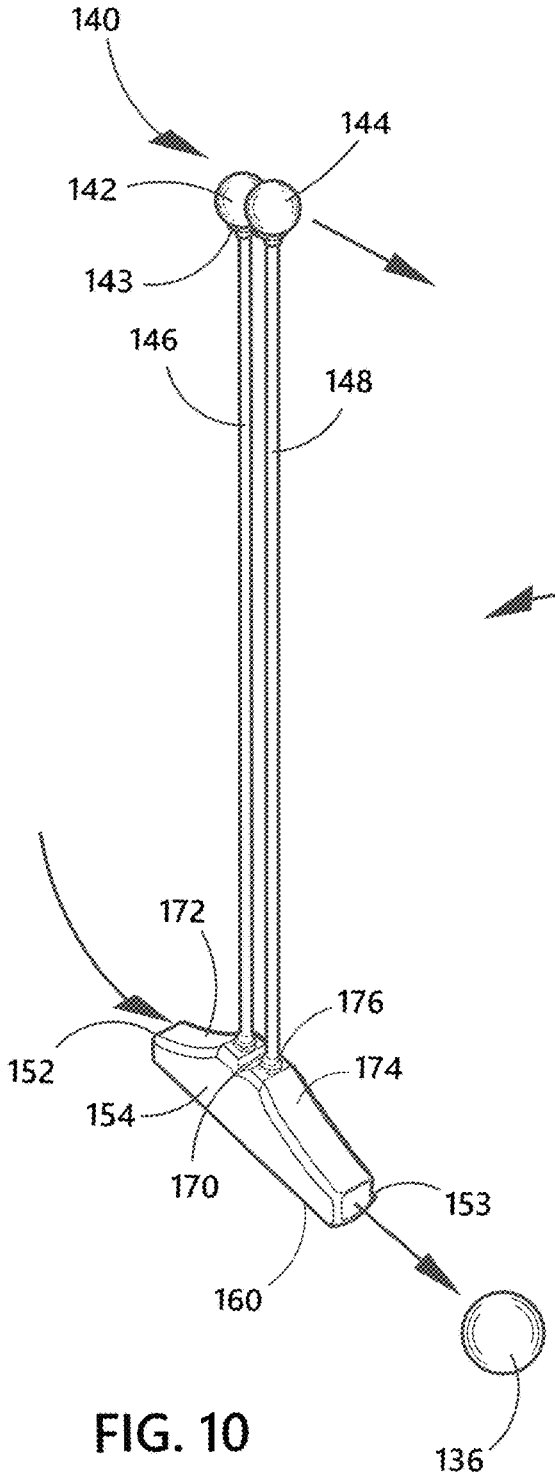
FIG. 10 depicts a top perspective view of a Combo Game Club showing the side tapping surface swinging toward a ball, here illustrating the handles moved together.

FIG. 10 depicts a top perspective view of a Combo Game Club 140 showing the side tapping surface 153 swinging toward a ball (see direction arrows), here illustrating the game club handles 142 and 144 moved together. The game club head 160 is shown here in greater detail. Game club shaft 148 threads into the club head 160 and is secured using a lock nut 176. Between the two club shafts is a notched portion 170 of the club head 160. The top surfaces 172 and 174 are sloped down to form a flat side surface 152 and 153 for tapping the game ball 136. In this view of the game club 140 the flat putting surface 154 is seen.

Figure 11:
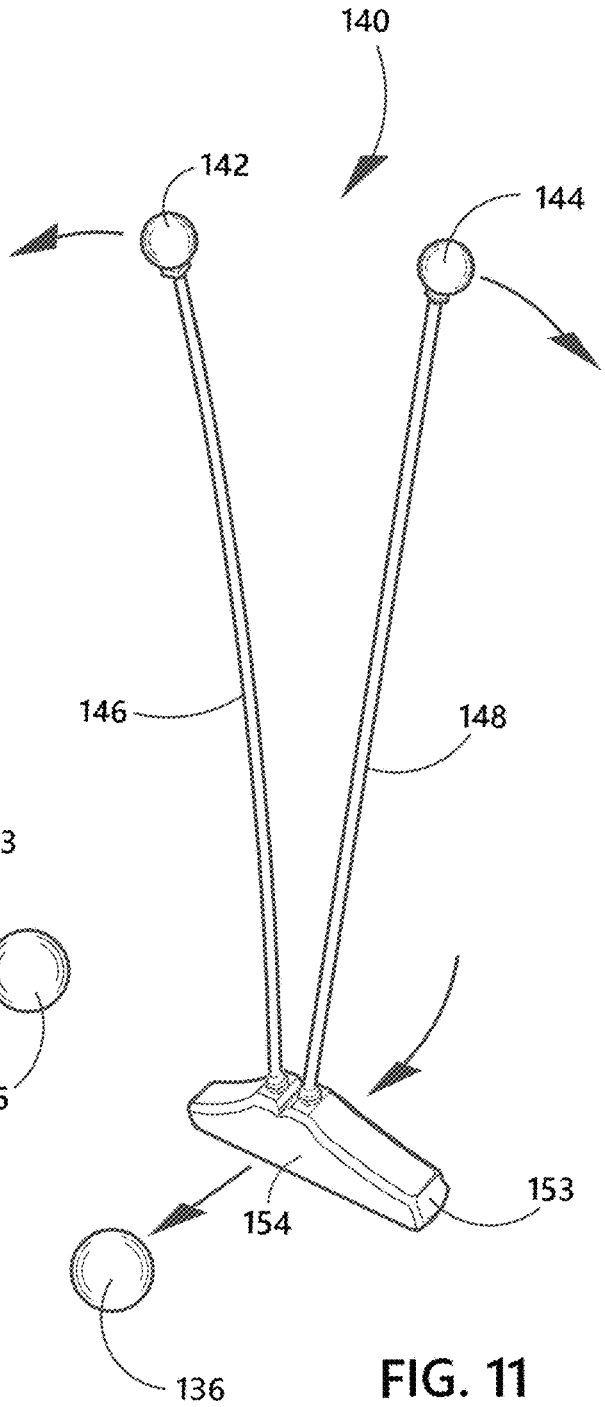
FIG. 11 depicts a top perspective view of a Combo Game Club showing the flat putting surface swinging toward a ball, here illustrating the handles spread apart by flexing the flexible Game Club shafts attached to the handles.

FIG. 11 depicts a top perspective view of a Combo Game Club 140 showing the flat putting surface 154 swinging toward a game ball 136, here illustrating the game club handles 142 and 144 spread apart by flexing outward the two flexible Game Club shafts 146 and 148 attached to the game club handles 142 and 144. Here, the game club 140 is shown being swung toward the game ball 136 in order to putt the game ball 136 using the flat putting surface 154 of the club head (see direction arrows). This would normally be done with the game player's feet apart and swinging the game club between the spread apart legs (see FIG. 4). So, in summary, there are at least 8 ways that the game club may strike or putt the game ball: (1) feet apart, handles together, flat surface putting; (2) feet apart, handles apart flat surface putting; (3) feet apart, handles together curved surface chipping; (4) feet apart, handles apart curved surface chipping; (5) feet together, handles together right side surface tapping; (6) feet together, handles apart right side surface tapping; (7) feet together, handles together left side surface tapping; and (8) feet together, handles apart left side surface tapping. Please see FIG. 12 through FIG. 23 for the details of the preferred embodiment of the game club construction.

Figure 12:
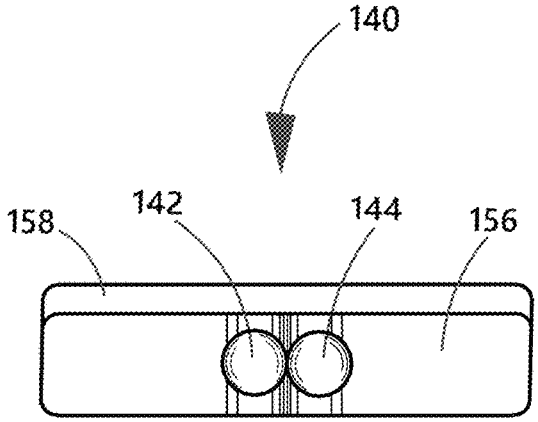
FIG. 12 depicts a top plan view of the Combo Game Club illustrating the handles moved together.

FIG. 12 depicts a top plan view of the Combo Game Club 140 illustrating the handles 142 and 144 moved together. In this view, the top surface of the club head 156 is seen as well as the curved surface 158 of one face of the club head 140 is shown. When looking down on the game club 140 there is seen the two game club handles 142 and 144, here shown moved together and touching.

Figure 13:
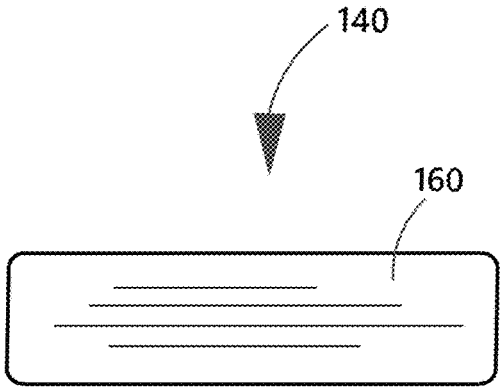
FIG. 13 depicts a bottom view of the Combo Game Club.

FIG. 13 depicts a bottom view of the Combo Game Club 140 showing the bottom flat surface of the game club head 160.

Figure 14:
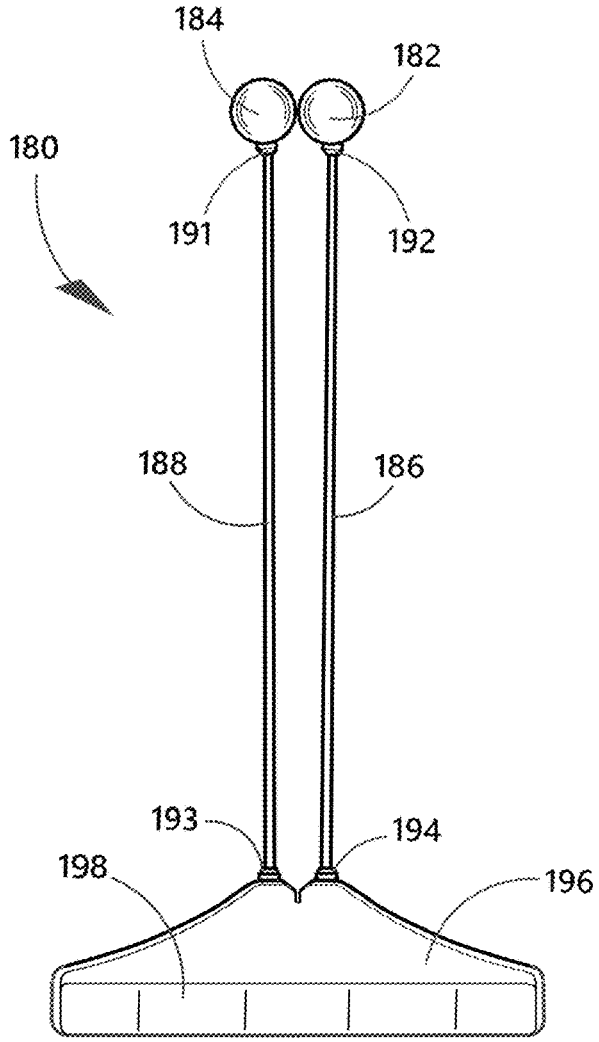
FIG. 14 depicts a rear view of the Combo Game Club illustrating the curved chipping surface and showing the handles moved together.

FIG. 14 depicts a rear view of an alternate embodiment of the Combo Game Club 180 having club handles 182 and 184 and short club shafts 186 and 188 size, designed for shorter players and children. This FIG. 14 also illustrates the game club head 196 having the curved chipping surface 198, and showing the handles 182 and 184 moved together. The handles 182 and 184 are secured to the flexible shafts 186 and 188, respectively, by employing lock washers 191 and 192. At the club head end, the flexible shafts 186 and 188 are secured to the club head 196 using lock washers 193 and 194. It is anticipated that the game club flexible shafts may come in varying sizes as desired and required for varying player's height and size.

Figure 15:
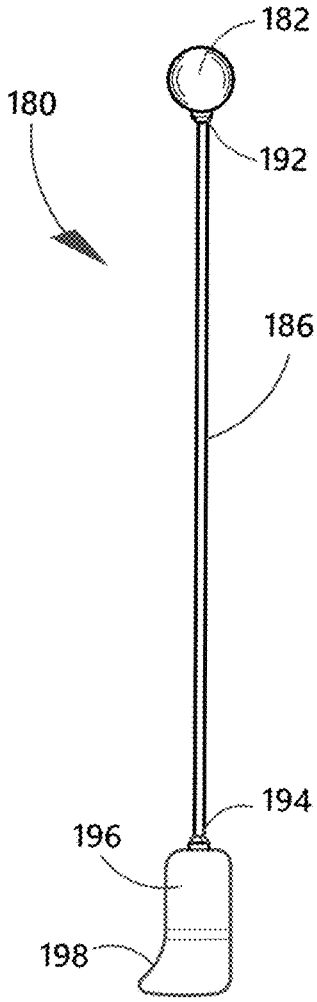
FIG. 15 depicts a side view of the Combo Game Club illustrating that the front surface of the club head is a curved chipping surface and the rear surface of the club head is a flat putting surface.

FIG. 15 depicts a side view of the alternate embodiment Combo Game Club 180 shown in FIG. 14, more clearly illustrating that the front surface of the club head 196 is a flat surface for putting and the rear surface of the club head 196 is a curved surface for chipping 198. Additionally, the shaft has a handle 182 secured to the flexible game club shaft 186 using a lock nut 192 as well as a club head 196 secured to the flexible game shaft 186 using lock nut 194.

Figure 16:
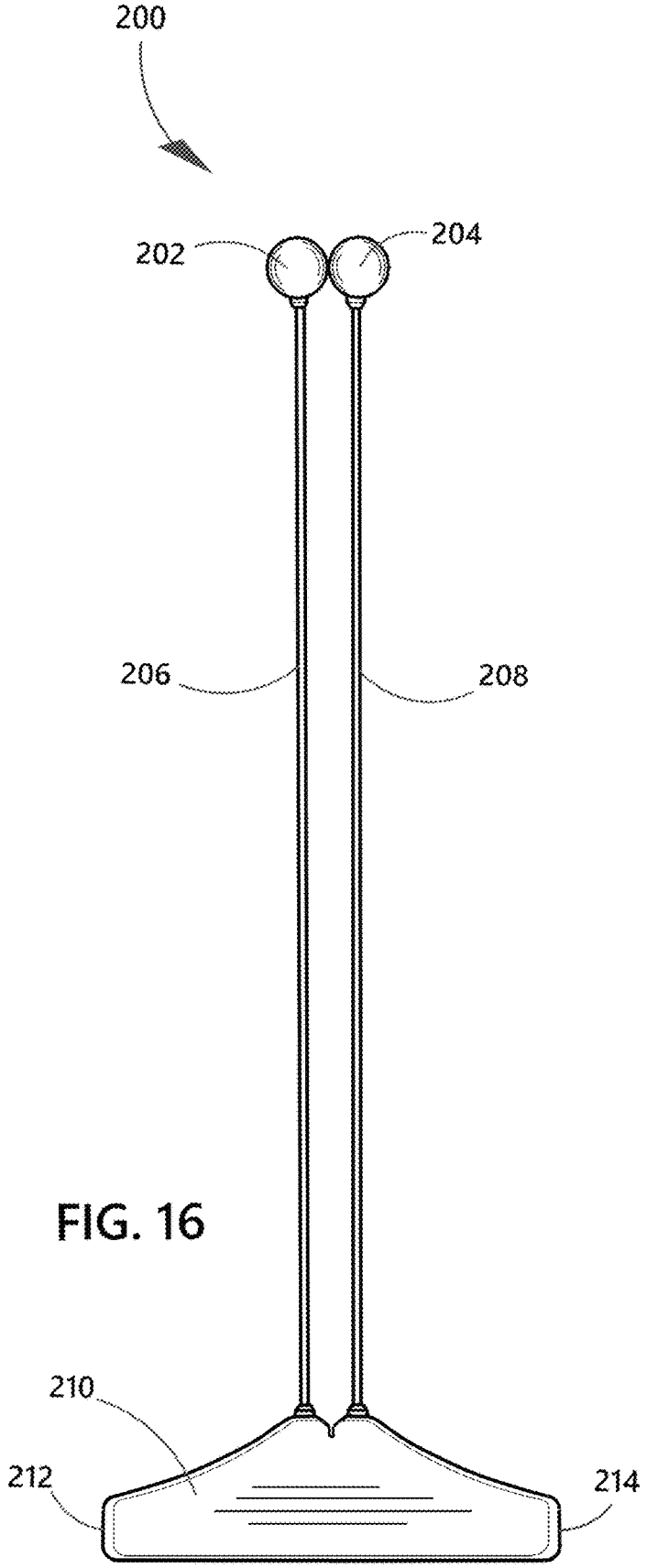
FIG. 16 depicts a front view of the Combo Game Club illustrating the flat putting surface and showing the handles moved together.

FIG. 16 depicts a front view of second alternate embodiment of the Combo Game Club 200 illustrating the alternate configuration game club 200 having extra-long flexible shafts 206 and 208 to accommodate taller game players. Here, the game club handles 202 and 204 are shown brought together and the flexible extra-long game club shafts 206 and 208 are nearly parallel to each other. The game club head 210 has game club sides 212 and 214 on both left side and the right side, respectively.

Figure 17:
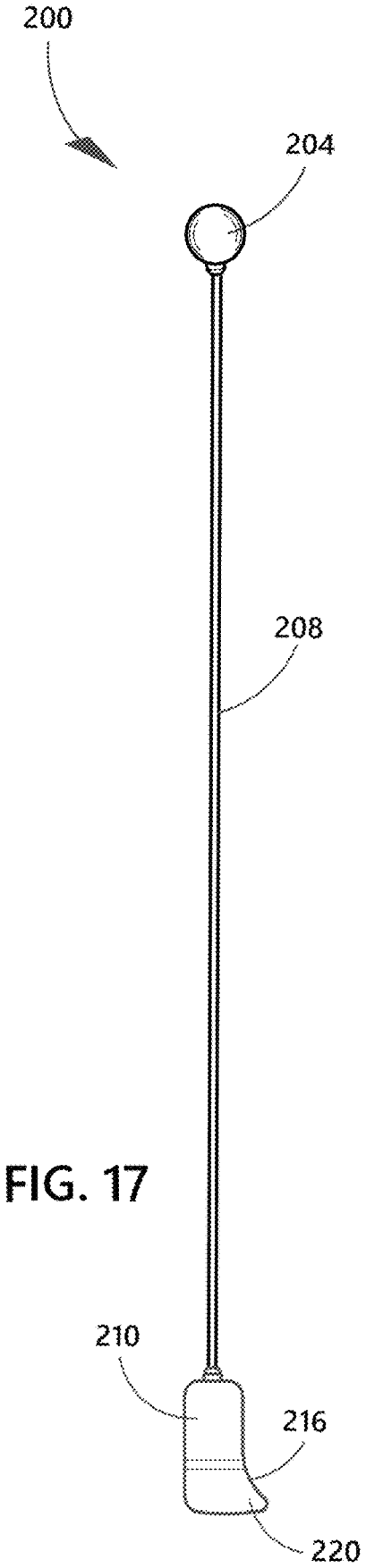
FIG. 17 depicts a side view of the Combo Game Club illustrating that the rear surface of the club head is a flat putting surface and the front surface of the club head is a curved chipping surface.

FIG. 17 depicts a side view of the second alternate embodiment of the Combo Game Club 200 shown in FIG. 16, here illustrating that the front surface of the club head 210 is a flat putting surface and the rear surface 216 of the club head is a curved chipping surface 220.

Figure 18:
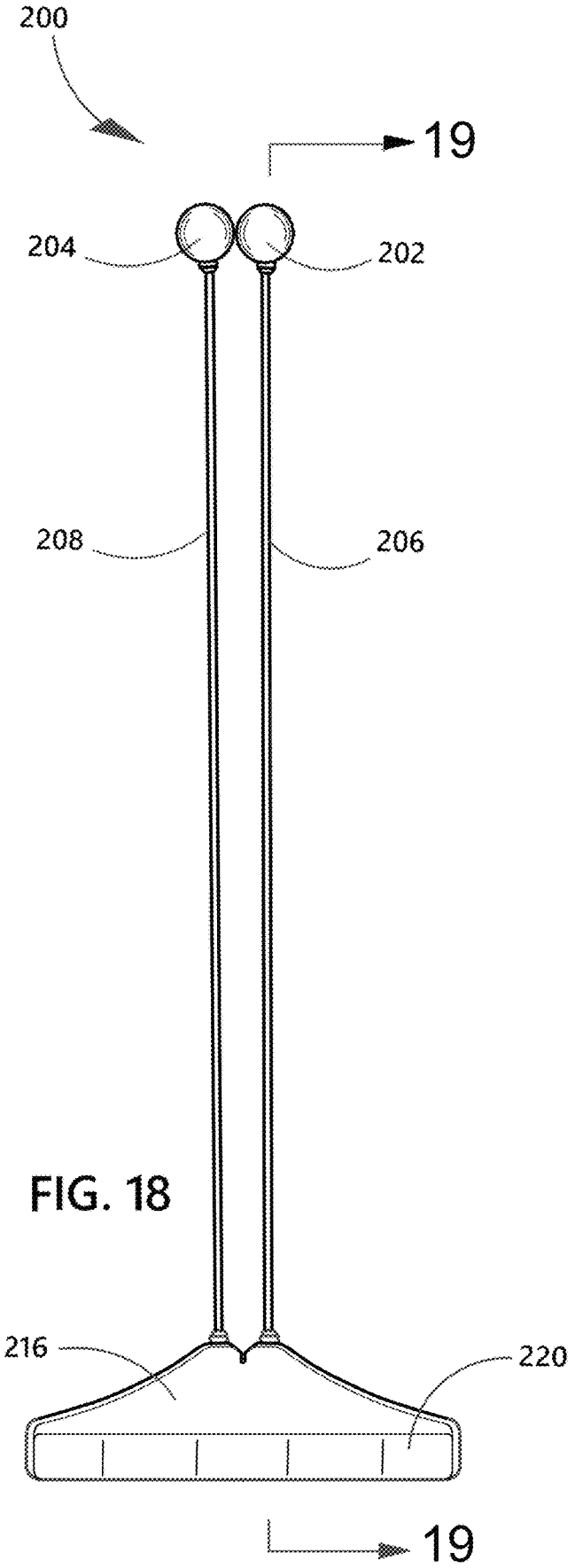
FIG. 18 depicts a rear view of the Combo Game Club illustrating the curved chipping surface and showing the handles moved together.

FIG. 18 depicts a rear view of the second alternate embodiment of the Combo Game Club 200 illustrating the club head 216 having a curved chipping surface 220 and showing the game club handles 202 and 204 moved together. As mentioned, here the extra-long flexible game club shafts 206 and 208 can be customized to any length to accommodate any player size and height as desired.

Figure 19:
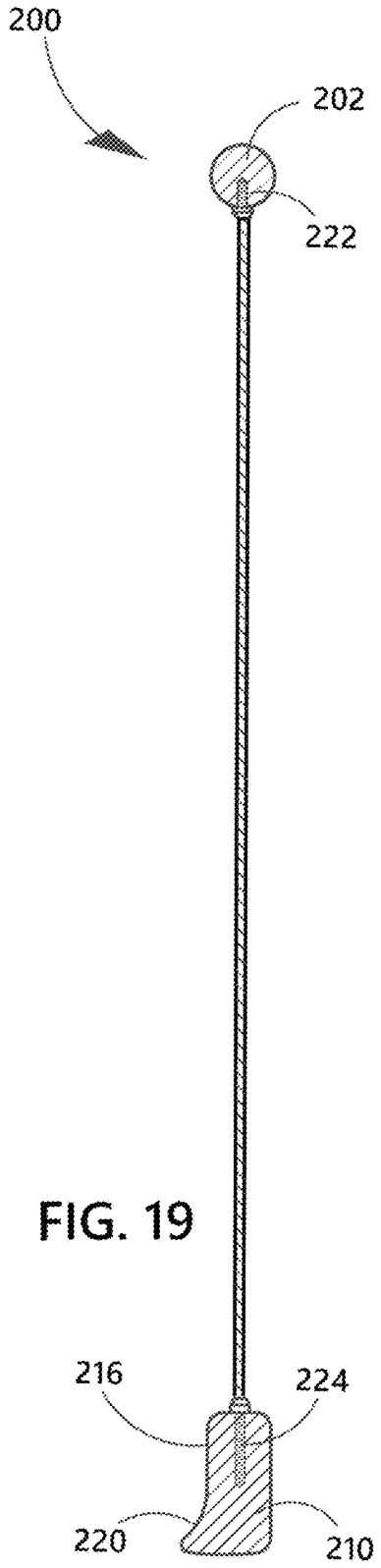
FIG. 19 depicts a cross-sectional side view of the Combo Game Club shown in FIG. 18, illustrating how the club handle and the club head are fastened to the flexible club shafts.

FIG. 19 depicts a cross-sectional side view of the second alternate embodiment of the Combo Game Club 200 shown in FIG. 18, illustrating how the club handle 202 and the club head 210 are fastened to the flexible club shafts using threaded screws 222 and 224, respectively.

Figure 20:
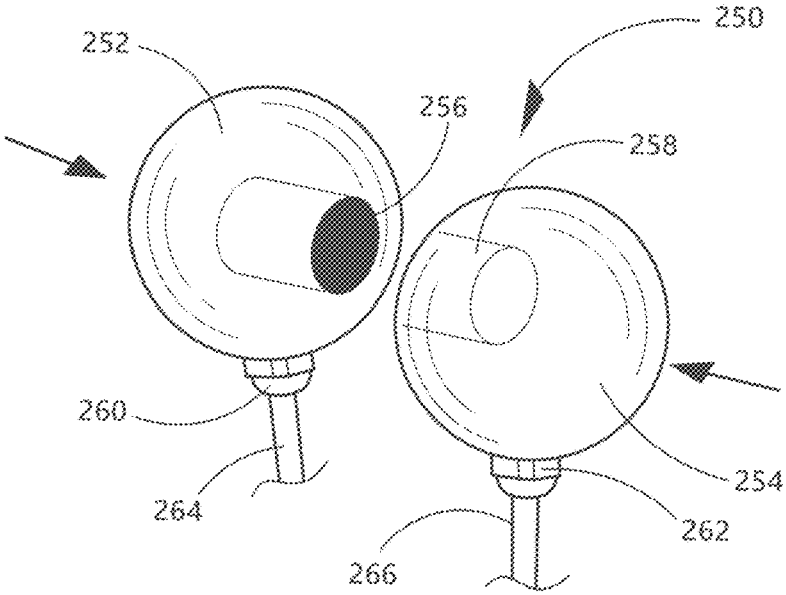
FIG. 20 depicts an enlarged partial cutaway view of the club handles illustrating an optional magnet within each club handle.

FIG. 20 depicts a third alternate embodiment of the Combo Game Club 250 showing an enlarged partial cutaway view of the club handles 252 and 254 brought together in close proximity and held together employing an optional magnet 256 and 258 located within each of the two club handles 252 and 254. Also shown here in FIG. 20 is the lock nuts 260 and 262 which secure the club handles 252 and 254 to the flexible club shafts 264 and 266, respectively.

Figure 21:
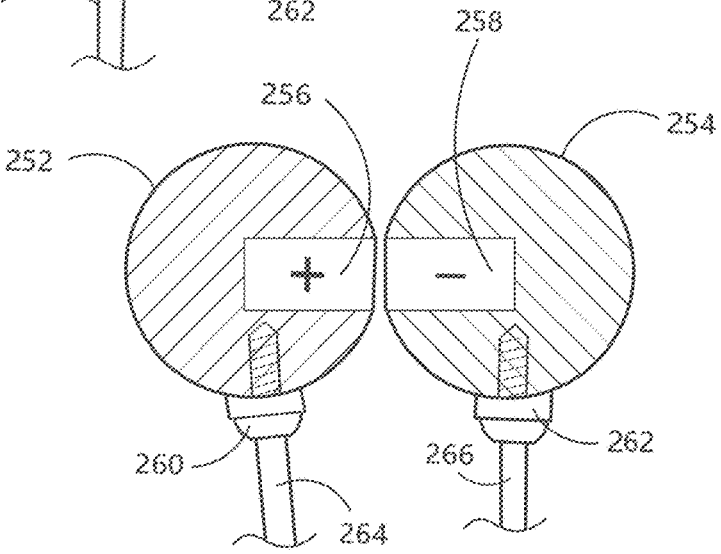
FIG. 21 depicts a front cross-sectional view of the club handles illustrating an optional magnet of differing polarity within each club handle and also illustrating how the club handle is fastened to the flexible club shaft.

FIG. 21 depicts a front cross-sectional view of the third alternate embodiment of the Combo Game Club 250 shown in FIG. 20. As seen in this cross-sectional view the club handles 252 and 254 include optional magnets 256 and 258 of differing polarity, plus and minus, located within each club handle 252 and 254. This FIG. 21 also illustrates how the club handles 252 and 254 are securely fastened to the flexible club shafts 264 and 266 using lock nuts 260 and 262 located below the threaded screws.

Figure 22:
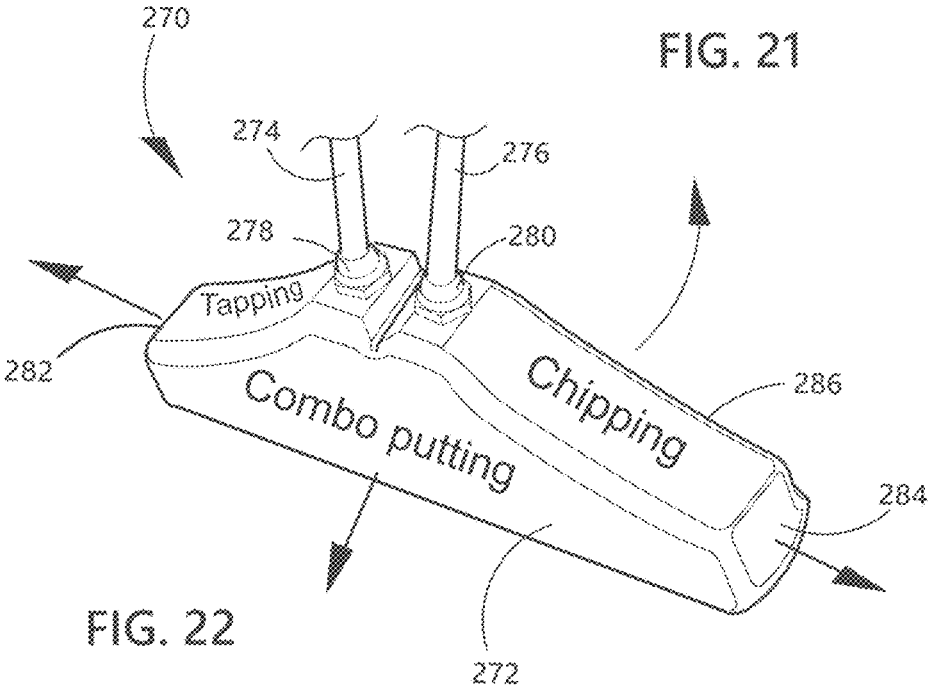
FIG. 22 depicts an enlarged partial top perspective view of the club head illustrating the three different ways a player can strike a ball, including a flat putting club head surface, a curved chipping club head surface, and two side tapping club head surfaces, one on each side of the club head.

FIG. 22 depicts an enlarged partial top perspective view of the Combo Game club head 270 illustrating the four different ways (see direction arrows) a player can strike a game ball using the game club, including a front flat putting club head surface 272, a rear curved chipping club head surface 286, and two side tapping club head surfaces 282 and 284, one on each side of the game club head 270. So, in summary, there are at least 8 ways that the game club may strike or putt the game ball: (1) feet apart, handles together, flat surface putting; (2) feet apart, handles apart, flat surface putting; (3) feet apart, handles together, curved surface chipping; (4) feet apart, handles apart, curved surface chipping; (5) feet together, handles together, right side surface tapping; (6) feet together, handles apart, right side surface tapping; (7) feet together, handles together, left side surface tapping; and (8) feet together, handles apart, left side surface tapping.

Figure 23:
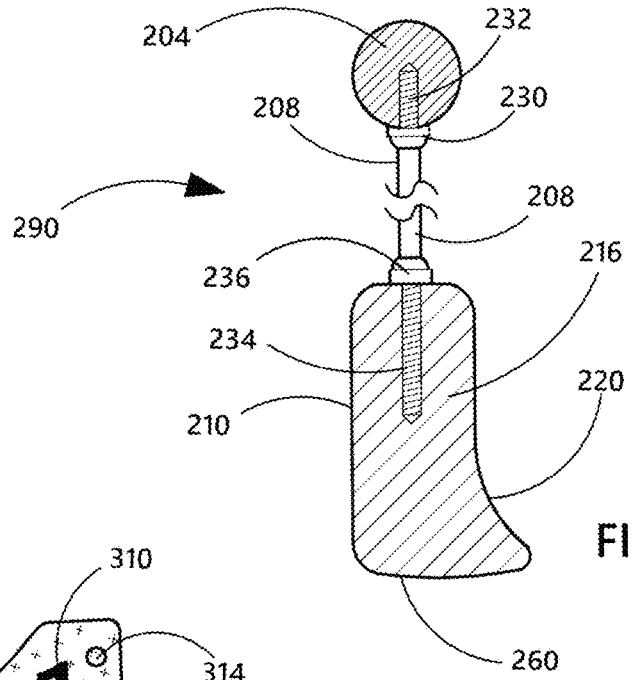
FIG. 23 depicts an enlarged cross-sectional side view of the game club illustrating the way in which the club handle and the club head are fastened to the flexible club shaft.

FIG. 23 depicts an enlarged cross-sectional side view of the Combo Family Game club 290 illustrating the way in which the club handle 204 and the club head 216 are securely fastened to the flexible club shaft 208. As seen, the club handle 204 is secured to the game club flexible shaft 208 using a threaded screw member 232 and associated lock nut 230. Likewise, the game club head 216 is securely fastened to the game club flexible shaft 208 using a threaded screw member 234 and associated lock nut 236. Other means of fastening the game club handle and the game club head to the flexible club shaft are also anticipated.

Figure 24:
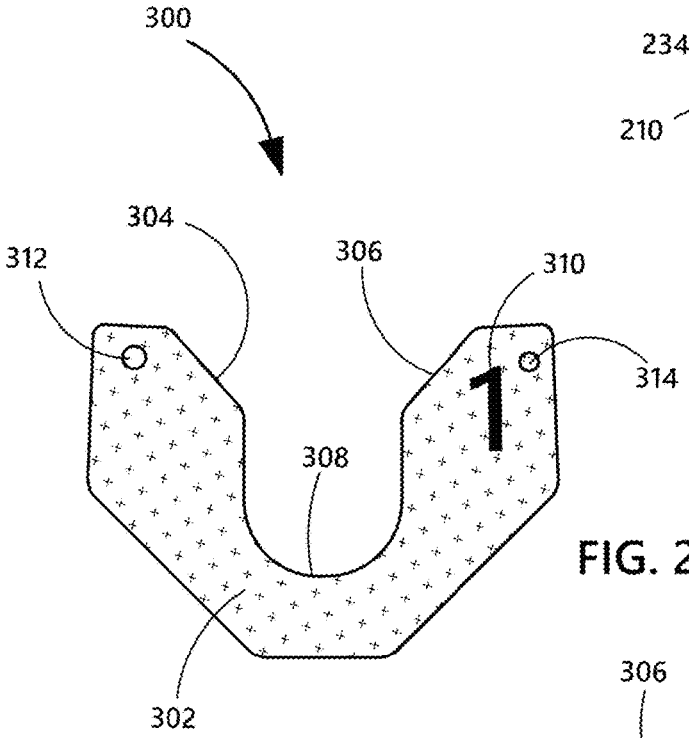
FIG. 24 depicts a top plan view of a game trap.

FIG. 24 depicts a top plan view of a U-shaped game ball trap 300. The game ball trap 300 has a flat surface 302 which includes two side portions 304 and 306 defining a centrally located ball accepting slot 308. The game ball trap 300 has a flat surface 302 may be numbered on one side or both sides with digit 310, and the flat surface 302 may include a sparkle reflective surface of varying colors and patterns. Additionally, the game ball trap 300 has a flat surface 302 may include one or more holes 314 for accepting flags and other decorations.

Figure 25:
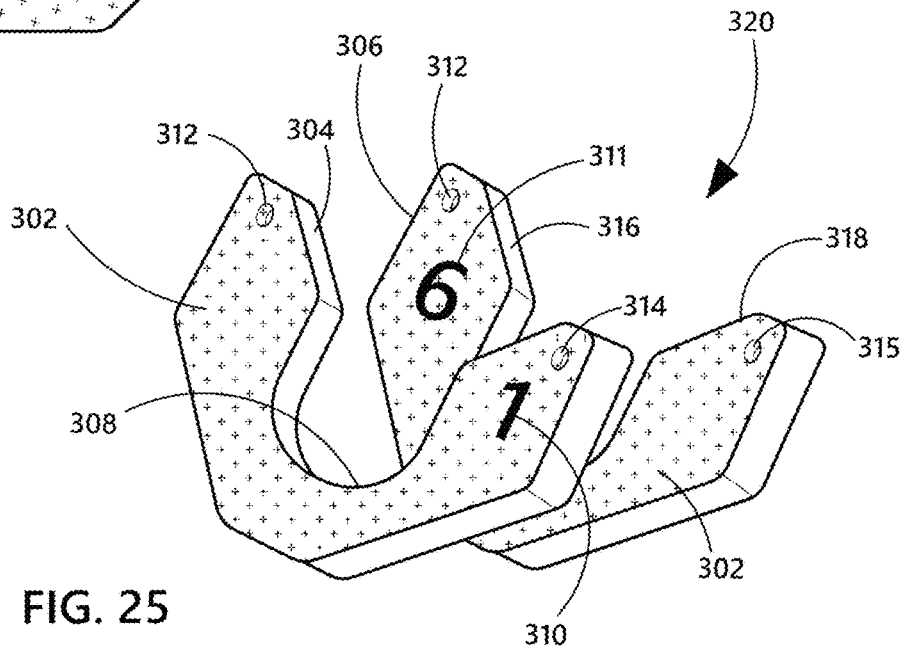
FIG. 25 depicts a top, side and front perspective view of a pair of game traps.

FIG. 25 depicts a top, side and front perspective view of a pair of U-shaped game ball traps 320. This pair of game ball traps is numbered 310 and 311 and includes two holes 312 and 315 in each of the game ball traps surfaces 302.

Figure 26:
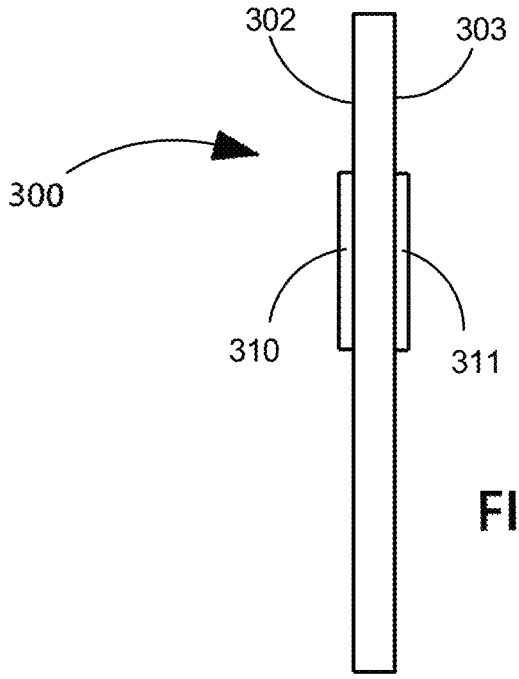
FIG. 26 depicts a side elevational view of the game trap shown in FIG. 24.

FIG. 26 depicts a side elevational view of the U-shaped game ball trap 300 shown in FIG. 24. This figure illustrates that the numbers 310 and 312 may be applied to both sides 302 and 303 of the game ball traps, and that in some instances the numbers may be raised, as is shown here in FIG. 26.

Figure 27:
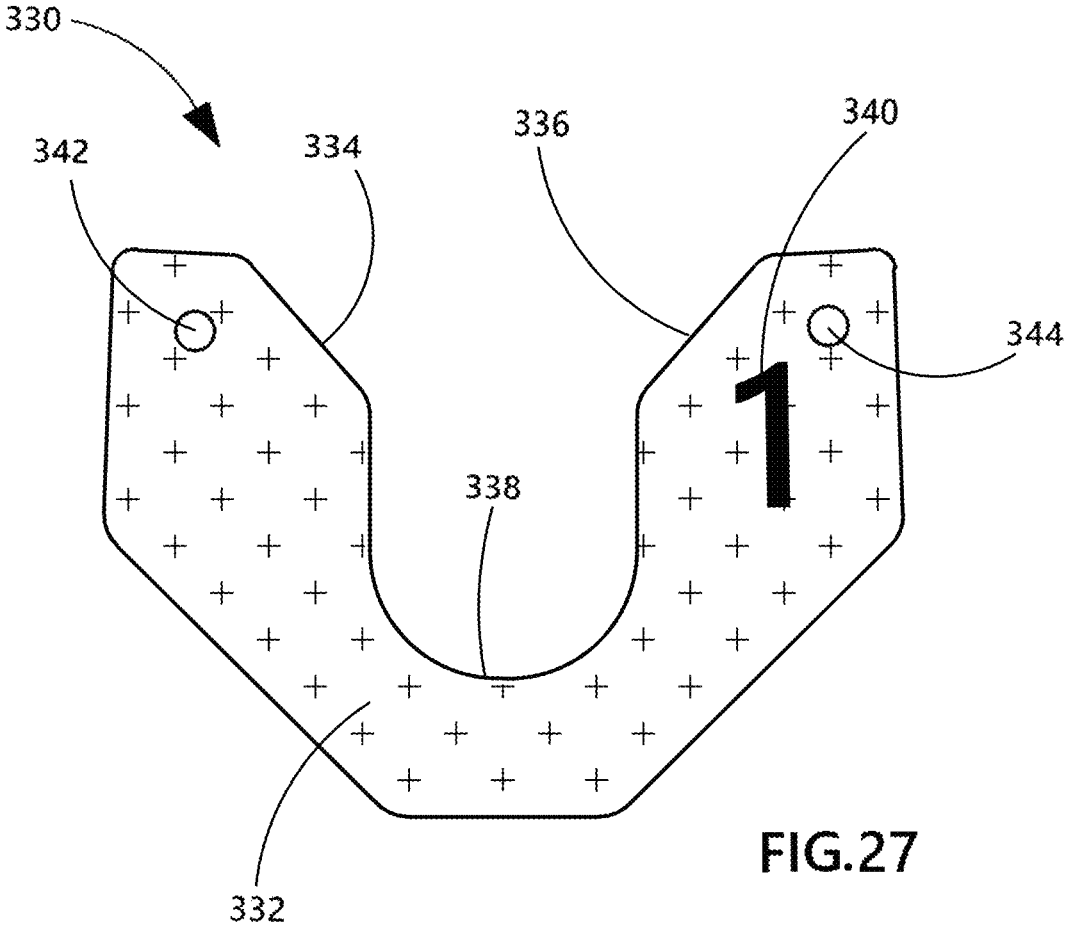
FIG. 27 depicts a top plan view of the upper front surface of a two-sided game trap.

FIG. 27 depicts a top plan view of the upper front surface of a U-shaped two-sided game trap 330 having one hole 340 for accepting a flag therein, and one number 340. Again, the two side portions 334 and 336 define the centrally located ball accepting slot 338. Here, the game ball trap 330 has a sparkle reflective surface 332.

Figure 28:
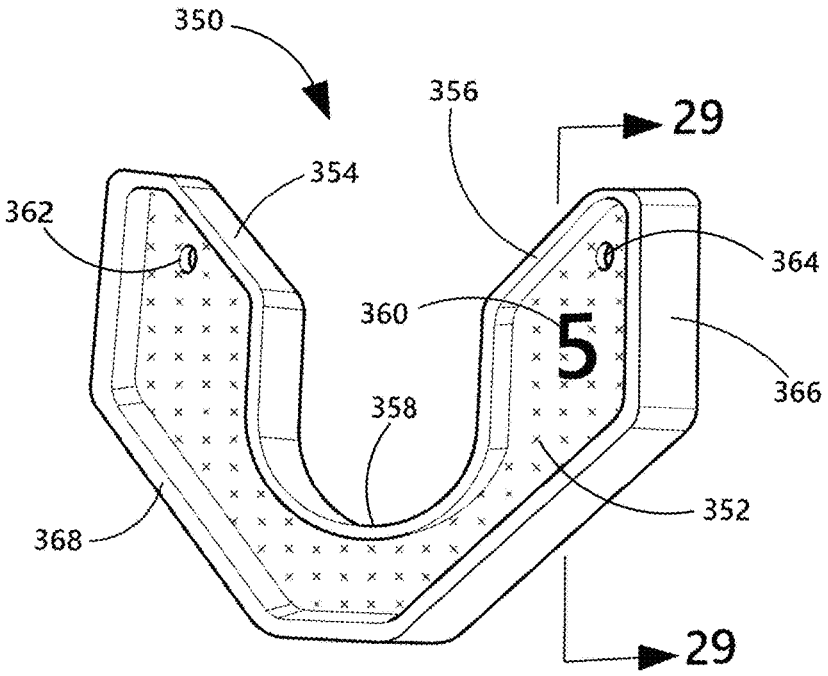
FIG. 28 depicts a top, side and front perspective view of an alternate embodiment of a game trap having a raised rim around its outer border.

FIG. 28 depicts a top, side and front perspective view of an alternate embodiment of a U-shaped game ball trap 350 having a raised outer border 366 and raised rim 368 located around the entirety of its outer border 366. Again, side portions 354 and 356 define a centrally located ball accepting slot 358. This game ball trap 350 includes a number "5" 360 on its surface 352. Additionally, this game ball trap 350 has two holes 362 and 364 for accepting flags and or decorative add-ons. This type of game trap 350 made be constructed of many differing materials, such as wood, plastic, composites, alloys and metal. One of the preferred materials for constructing this type of raised border game ball trap would be bronze. When they are made from bronze, the game ball traps may be collected, saved and considered a family heirloom piece.

Figure 29:
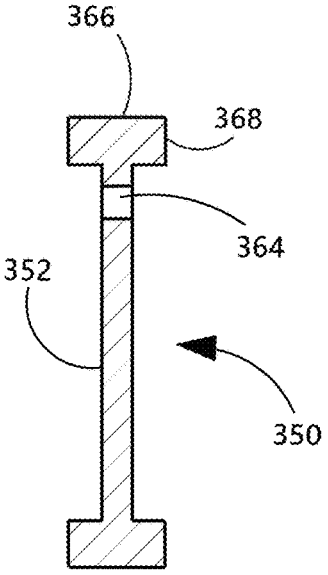
FIG. 29 depicts a side elevational cross-sectional view of the game trap as shown in FIG. 28.

FIG. 29 depicts a side elevational cross-sectional view of the U-shaped game ball trap 350 as shown in FIG. 28. Here, it is clearly evident that the game ball trap surface 352 includes a raised border 366 and a raised rim 368. The raised border 366 and raised rim 368 may be of various thicknesses. Also seen is the through hole 364 for accepting flags and other decorations.

Figure 30:
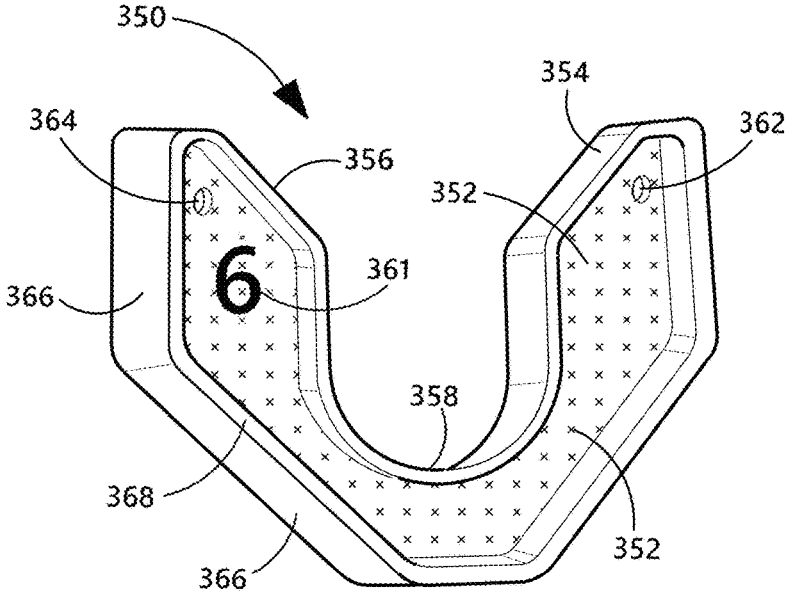
FIG. 30 depicts a top, side and front perspective view of an alternate embodiment of a game trap having a raised rim around its outer border, illustrating the opposite side of the game trap shown in FIG. 28.

FIG. 30 depicts a top, side and front perspective view of an alternate embodiment of a U-shaped game ball trap 350 having a raised rim around its outer border, illustrating the opposite side of the game trap shown in FIG. 28. In addition to all of the features of the game ball trap 350 as shown in FIG. 28, the opposite side of the game ball trap 350 also has a number "6" 361 thereon.

Figure 31:
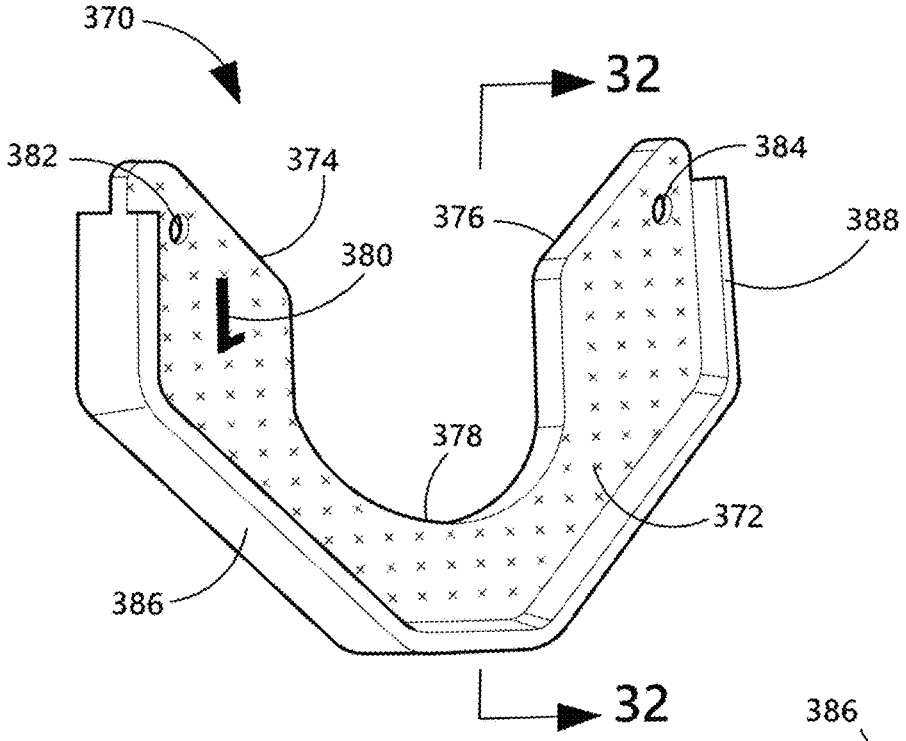
FIG. 31 depicts a top, side and front perspective view of a second alternate embodiment of a game trap having a raised rim around its outer border wherein that raised rim is only present on part of the game trap that being the ball pocket part of the game trap which accepts the ball.

FIG. 31 depicts a top, side and front perspective view of a second alternate embodiment of a U-shaped game trap 370 having a raised rim 386 and 388 around its outer border wherein that raised rim is only present on part of the game ball trap 370 with that raised rim being absent around the sides 374 and 376 which define the ball pocket 378 part of the game trap which accepts the ball. Again, there is a flat surface 372, here shown with sparkles or a reflective pattern, and there are two flag and or decoration accepting holes 382 and 384 therein. In addition, this game ball trap 370 bears the number "1" 380 on its upper surface 372.

Figure 32:
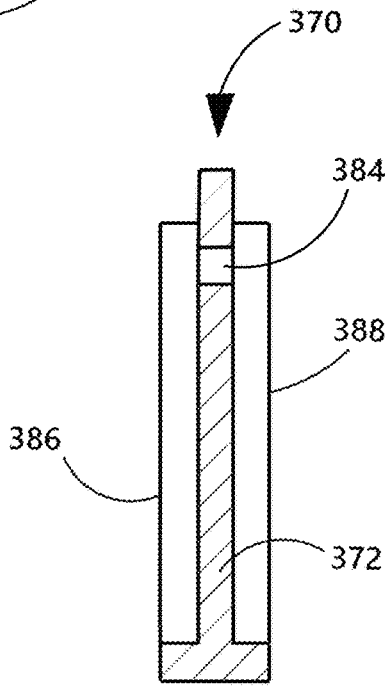
FIG. 32 depicts a side elevational cross-sectional view of a second alternate embodiment of a game trap as shown in FIG. 31.

FIG. 32 depicts a side elevational cross-sectional view of a second alternate embodiment of a U-shaped game ball trap 370 as shown in FIG. 31. Here in this cross-sectional view there is seen the surface 372, the raised rim 386 and 388 partially surrounding the game ball trap, and the flag and or decoration hole 384.

Figure 33:
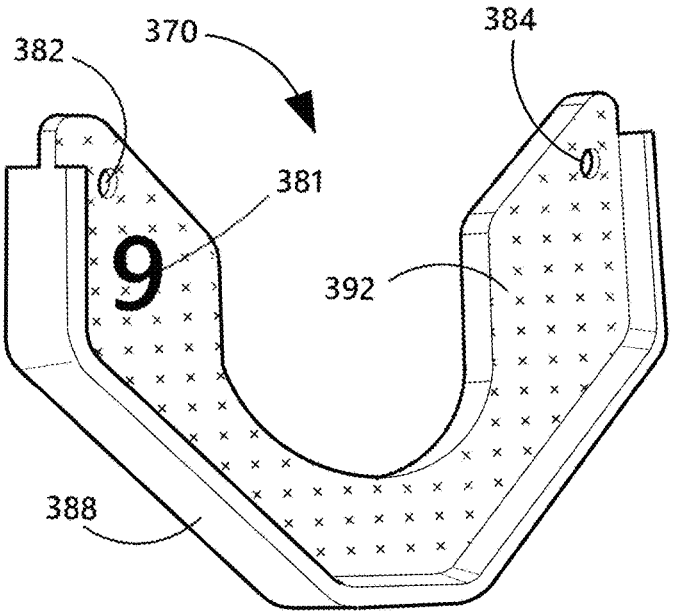
FIG. 33 depicts a top, side and front perspective view of an alternate embodiment of a game trap having a raised rim around its outer border, illustrating the opposite side of the game trap shown in FIG. 31.

FIG. 33 depicts a top, side and front perspective view of an alternate embodiment of a U-shaped game trap having a raised rim partially around its outer border, illustrating the opposite side of the game trap shown in FIG. 31. In addition, this opposite side of the game ball trap 370 bears the number "9" 381 on its upper surface 392. In this way, the game ball traps have either one number on one side or two numbers located on both sides.

Figure 34:
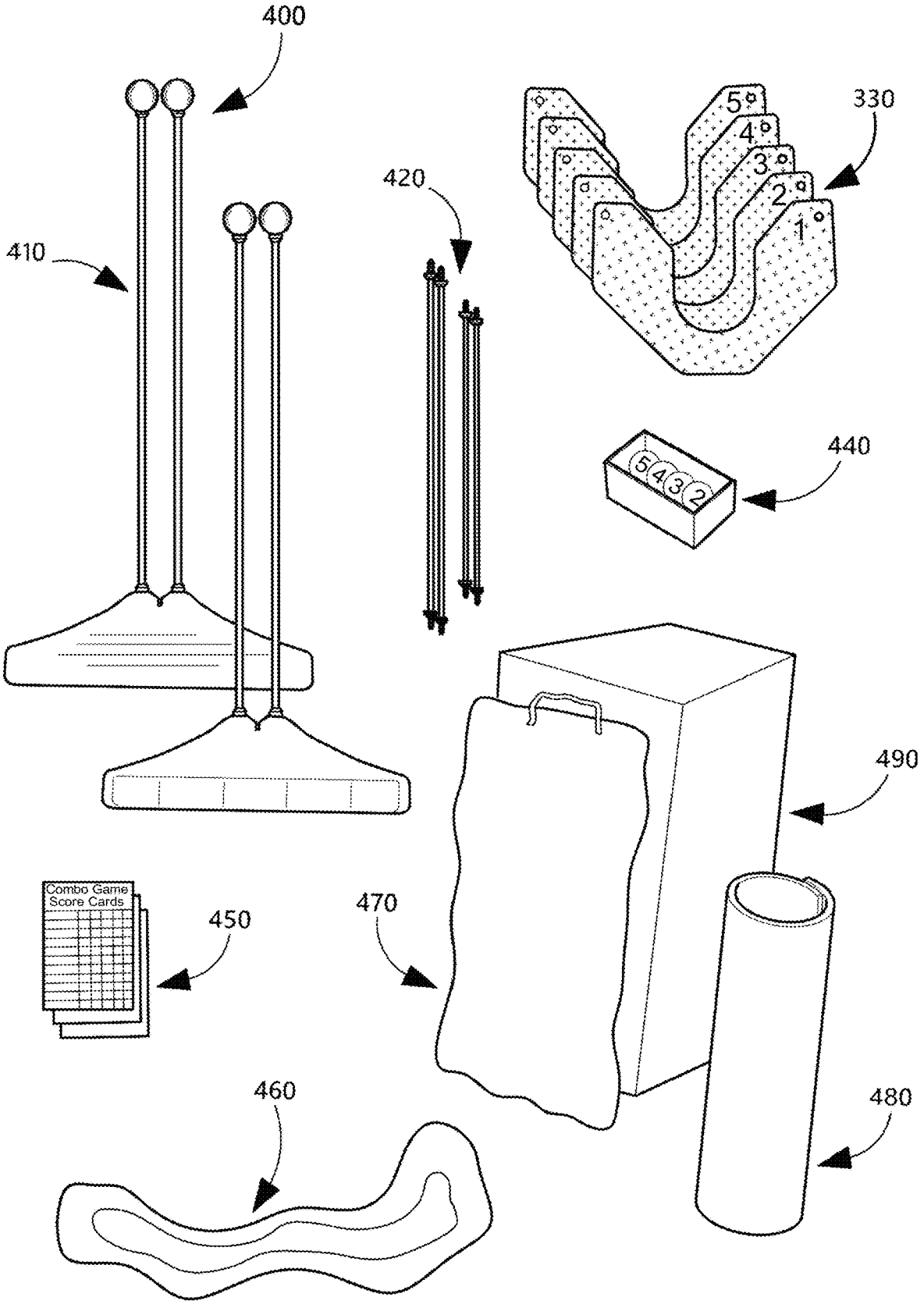
FIG. 34 depicts a complete Combo Family Game kit illustrating all of the various components of the game kit.

FIG. 34 depicts a complete Combo Family Game kit 400 illustrating all of the various components of the Combo Family Game portable game kit. The portable Combo Family Game kit shown here includes the following components: one or more game clubs 410, one or more differing sizes of game club shafts 420, one or more game ball traps 430, one or more game balls 440, one or more game score cards 450, one or more game mat obstacles 460, a game kit portable carry bag 470, a game mat 480, and a box 490 for packaging all of the other components into a portable kit for sale and transport.

Figure 35:
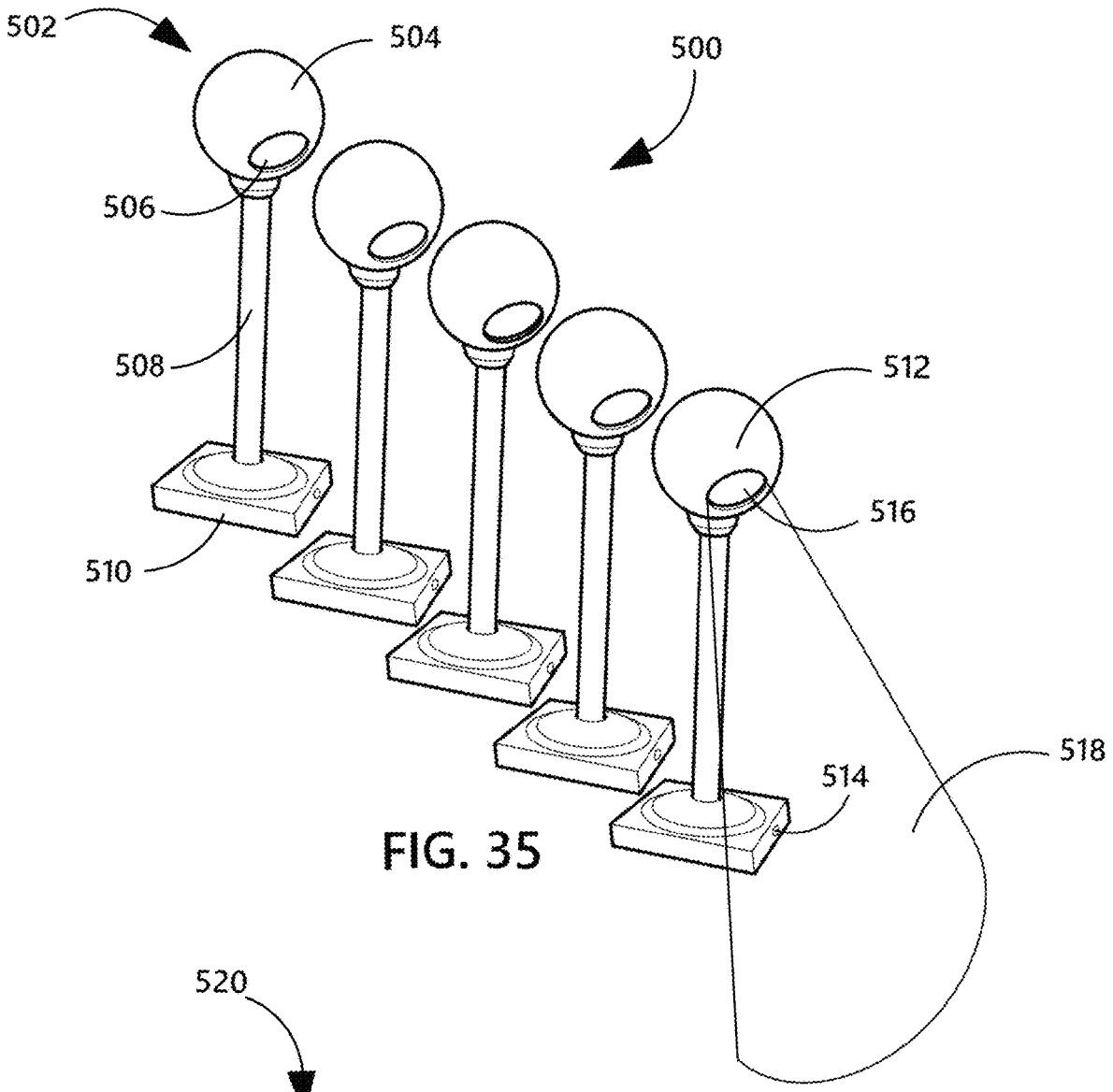
FIG. 35 depicts a set of optional Combo Family Game lights.

FIG. 35 depicts a set of optional Combo Family Game lights 500. Each light 502 includes a lamp globe 504 having a light hole 506, a light post 508 and a lamp base 510. In operation, a wiring kit us used to wire the lights through wire port 514, and when powered the light source within the light globe 512 is emitted out of the light hole 516 and shines down in a light pattern 518. When the light kit 500 is coupled to the Combo Family Game portable kit 400 (see FIG. 34), or a permanent installation of the Combo Family Game 10, the game can be played at night or outside under dark conditions as well as indoors with no other lights on.

Figure 36:
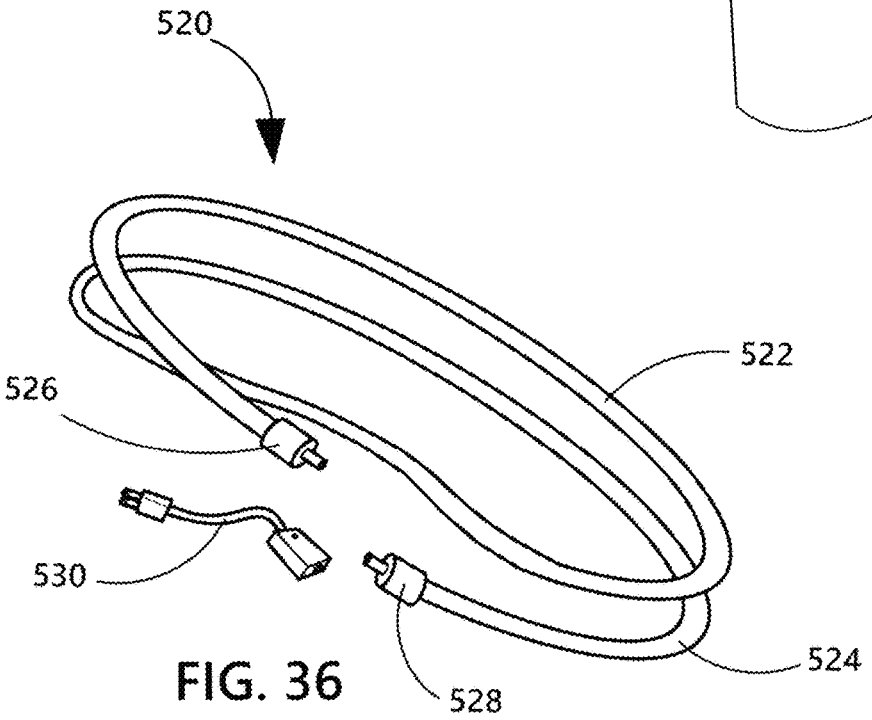
FIG. 36 depicts a wiring and adapter kit to be used to hard wire the set of optional Combo Family Game lights shown in FIG. 35.

FIG. 36 depicts a wiring and adapter kit 520 to be used to hard wire the set of optional Combo Family Game lights shown in FIG. 35. This wiring adapter kit 520 includes one or more lighting wires 522 and 524, having wire connections 526 and 528 on each end, as well as a wire kit adapter 530 for plugging in the individual lights (see FIG. 35).

Figure 37:
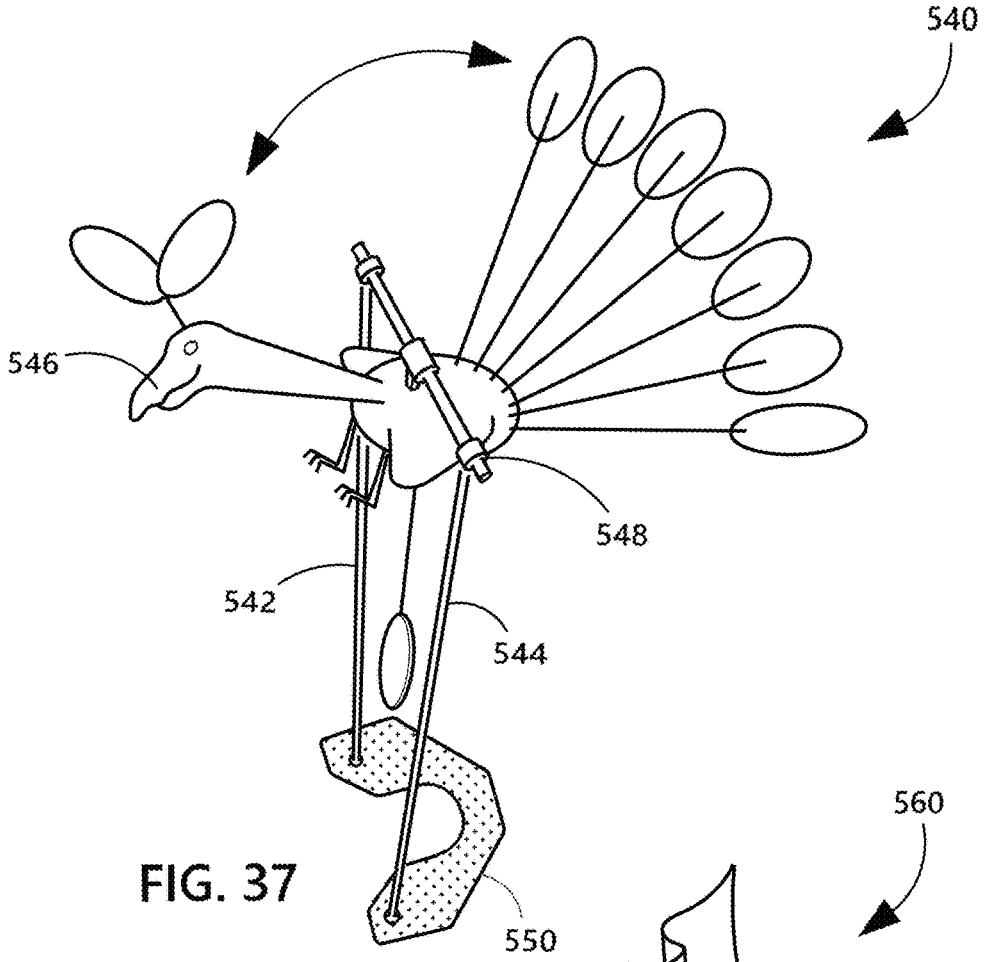
FIG. 37 depicts an optional game trap ornament, here illustrating a rocking peacock decoration attachable to the game traps.

FIG. 37 depicts an optional game trap ornament, here illustrating a rocking peacock decoration 540 attachable to the game ball traps 550 using the mounting poles 542 and 544. The decorative peacock ornament body 546 shown here includes a cross bar 548, and when the peacock is suspended from the cross bar 548 as shown, it will swing either in the wind when used outdoors, or when struck by a ball (see direction arrows).

Figure 38:
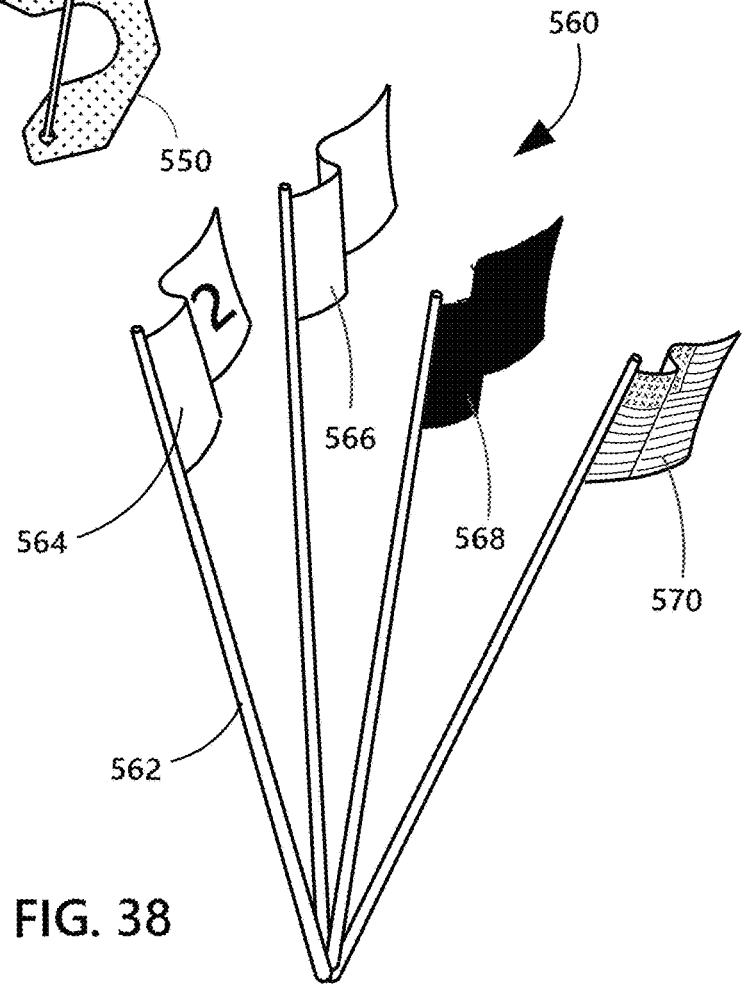
FIG. 38 depicts an optional flag set attachable to the game traps.

FIG. 38 depicts an optional flag set 560 attachable to the game ball traps in the mounting holes as earlier described (see FIG. 1 and FIG. 27). Each flag has a pole 562 and those poles are inserted into the holes found in the game ball traps. Flags may be of numerous varying types, numbered 564 or not numbered 566 and of varying colors 568 or varying pattern designs such as the American Flag 570.

Family Combo Game primary features will include as prominent design and operational features: a combo family game comprising: (a) a game mat playing surface; (b) one or more game balls; (c) one or more game clubs; and (d) one or more game ball traps. The game mat playing surface comprises a flat surface and the game mat playing surface may include a raised border to prevent the game ball from rolling off said game mat playing surface. The game mat playing surface may also include one or more game surface obstacles capable of being adjustably arranged in a variable desired pattern. The game mat playing surface may be constructed of artificial grass or turf. The combo family game balls includes billiard balls. The combo family game billiard balls are configured in varying colors, varying numbers and varying patterns. The combo game clubs include game clubs having two game club handles, two game club flexible shafts and one game club head. The combo family game clubs have a game club head which includes four different striking surfaces. Those four different striking surfaces includes a flat putting surface, a curved chipping surface, a left side tapping surface and a right side tapping surface. The combo family game club each have two game club handles including spherically shaped handles. The combo family game club handles may further include magnets therein. The combo family game clubs with two game club flexible shafts include flexible shafts configured in varying sizes for accommodating varying sized game players. The combo family game clubs have two game club flexible shafts which are secured to said two game club handles on one end using lock nuts and the two game club flexible shafts are secured to said club head on the opposite end. The combo family game ball traps include flat surfaced U-shaped game ball traps having a ball accepting slot integrated therein. The combo family game flat surfaced U-shaped game ball traps further include a sparkle surface and reflective surface and can be numbered.

The combo family game is configured such that all of said game components are assemble for sale in a portable combo family game kit. The combo family game wherein said portable combo family game kit further includes a lighting and wiring kit component. The combo family game wherein said portable combo family game kit further includes a decorations and flags kit component. The combo family game is configured such that said combo family game is capable of being portable, and taken to the backyard or a park to set up for playing the Combo Family Game in a temporary capacity. Moreover, the combo family game is configured such that said Combo Family Game is capable of being constructed as a permanent structure and thereby integrated into a fun center, an amusement park, or in any family recreation area.

Combo Family Game is played when you receive a package of the small game components including an optional roll of playing low turf with a four-inch-wide longer turf edge that will retain the playing of the ball within the central area of the course. The game will consist of one or more traps, with five to six traps typically numbered one through six of one color that will be turned over to expose the numbers seven through twelve of the other color to be located around the playing area of the Combo Family Game course. The traps with different colors on the front from the back that should be layout in no specific pattern but when a player hits the ball into the last trap all the players will tum the traps over with no specific random locations. There will be one or more Combo clubs, with varying length shafts, and four or more playing balls, and a pack of numerous score cards in the storage box.

The game starts over with the optional locations of the game ball traps of each player's desire. The player lays the ball on the mat playing surface close to the center of the course to make the first hit at the number one target, then player one strikes the ball. After the remaining players finish the game, they will add up the number of times that they have hit their ball to place it into each of the set up game ball traps on the course. The winner will be determined who had the fewest number times that they have struck the ball, similar to golf.

To play the game of Combo the players will use a single new style of a two handled, flexible shaft flat sided and curved sided club. This unique game club is used by either swinging it between their legs in a pendulum swing to tap the ball with flat front side to putt or tap the ball straight in the forward position by using the sight line on the club top surface. Hitting the balls very hard is not recommended but hitting the ball firmly works well. By using the opposite back side of the club with the curvature of the club surface to chip the game ball will cause a lifting of the ball over obstacles, longer turf surfaces or in a sandy area. The club can be used in either direction to tap the ball across the body to tap the ball lightly for short distance accuracy.

The game is started by the first player who puts his or her ball in the center of the playing surface and starts by hitting it toward the first trap, trap number one. When the ball enters the trap, they can go on to the next set of placed game ball traps in order, and when all the players have struck the game ball into the last trap the all the traps can be turned over to start the second half of the game. The winner is decided by the player who scored the lowest number of times hitting the game balls into the traps on the set up course, and said score is entered into the score cards for a final tally of hits required to run the entire course.

The Family Combo Game 10, the Combo Game Club 40 and 140, the Combo game traps 300, 320, 330, 350 and 370, as well as a Combo Family Game kit 400 and optional Combo Family Game lights 500, lighting wiring 520 and various game trap decorations 540 and game trap flags 560 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Family Combo Game 10, the Combo Game Club 40 and 140, the Combo game traps 300, 320, 330, 350 and 370, as well as a Combo Family Game kit 400 and optional Combo Family Game lights 500, lighting wiring 520 and various game trap decorations 540 and game trap flags 560 in accordance with the spirit of this disclosure, and such changes, alternations and modifications as would occur to those skilled in the art are considered to be within the scope of this design as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A combo family game comprising:

(a) a game mat playing surface;

(b) one or more game balls;

(c) one or more game clubs wherein said one or more game clubs include game clubs having two game club handles, two game club flexible shafts and one game club head and further wherein said two game club handles include magnets located therein; and (d) one or more game ball traps.

2. The combo family game according to claim 1, wherein said game mat playing surface comprises a flat surface.

3. The combo family game according to claim 2, wherein said game mat playing surface includes a raised border to prevent the game ball from rolling off said game mat playing surface.

4. The combo family game according to claim 2, wherein said game mat playing surface includes one or more game surface obstacles capable of being adjustably arranged in a variable desired pattern.

5. The combo family game according to claim 2, wherein said game mat playing surface includes artificial turf.

6. The combo family game according to claim 1, wherein said one or more game balls includes billiard balls.

7. The combo family game according to claim 6, wherein said billiard balls are of varying colors, varying numbers and varying patterns.

8. The combo family game according to claim 1, wherein said one or more game clubs include game clubs having two game club handles, two game club flexible shafts and one game club head.

9. The combo family game according to claim 8, wherein said game club head includes four different striking surfaces.

10. The combo family game according to claim 9, wherein said four different striking surfaces includes a flat putting surface, a curved chipping surface, a left side tapping surface and a right side tapping surface.

11. The combo family game according to claim 8, wherein said two game club handles include spherically shaped handles.

12. The combo family game according to claim 11, wherein said spherically shaped handles further include cylindrically shaped magnets of differing polarity, plus and minus, located within each club handle.

13. The combo family game according to claim 8, wherein said two game club flexible shafts include flexible shafts in varying sizes for accommodating varying sized game players.

14. The combo family game according to claim 8, wherein said two game club flexible shafts are secured to said two game club handles on one end using lock nuts and further wherein said two game club flexible shafts are secured to said club head on the opposite end.

15. The combo family game according to claim 1, wherein said one or more game ball traps include flat surfaced U-shaped traps having a ball accepting slot integrated therein.

16. The combo family game according to claim 15, wherein said flat surfaced U-shaped traps further include a sparkle surface and reflective surface.

17. The combo family game according to claim 1, wherein all of said game components are assembled for sale in a portable combo family game kit.

18. The combo family game according to claim 17, wherein said portable combo family game kit further includes a lighting and wiring kit component.

19. The combo family game according to claim 1, wherein said portable combo family game kit further includes a decorations and flags kit component.

20. The combo family game according to claim 1, wherein said combo family game is constructed as a permanent structure in a family recreation area.

* * * * *